US012557906B1

(12) United States Patent
Walz

(10) Patent No.: US 12,557,906 B1
(45) Date of Patent: Feb. 24, 2026

(54) HEATING TABLE ASSEMBLY

(71) Applicant: Adam Walz, Western Spring, IL (US)

(72) Inventor: Adam Walz, Western Spring, IL (US)

( * ) Notice: Subject to any disclaimer, the term of this patent is extended or adjusted under 35 U.S.C. 154(b) by 1036 days.

(21) Appl. No.: 17/649,289

(22) Filed: Jan. 28, 2022

Related U.S. Application Data

(60) Provisional application No. 63/142,584, filed on Jan. 28, 2021.

(51) Int. Cl.
*A47B 31/02* (2006.01)
*F24D 13/00* (2006.01)
*F24H 3/04* (2022.01)

(52) U.S. Cl.
CPC ..... *A47B 31/02* (2013.01); *F24D 13/00* (2013.01); *F24H 3/04* (2013.01)

(58) Field of Classification Search
CPC ..... F24H 3/04; F24D 13/00; A47B 31/02
USPC ..... 219/623
See application file for complete search history.

(56) References Cited

U.S. PATENT DOCUMENTS

| | | | | |
|---|---|---|---|---|
| 3,903,846 | A * | 9/1975 | Elliott | F23C 10/00 432/27 |
| 4,404,953 | A * | 9/1983 | Thulman | F24B 5/021 126/193 |
| 7,537,015 | B1 | 5/2009 | Molnar, IV et al. | |
| 2008/0308645 | A1* | 12/2008 | Presley | F23D 14/20 29/428 |
| 2011/0146542 | A1 | 6/2011 | Branning | |
| 2012/0210994 | A1* | 8/2012 | Gulotta | F24C 3/022 126/39 R |
| 2013/0216213 | A1 | 8/2013 | Thomas | |
| 2014/0096707 | A1 | 4/2014 | Westbrook et al. | |
| 2015/0250305 | A1 | 9/2015 | Kahler et al. | |
| 2017/0097172 | A1 | 4/2017 | Alioli | |
| 2018/0058690 | A1* | 3/2018 | Becker | G05B 19/042 |
| 2018/0252414 | A1* | 9/2018 | Greiwe | F24B 3/00 |
| 2020/0128955 | A1* | 4/2020 | Molnar | F24F 1/03 |

FOREIGN PATENT DOCUMENTS

| | | | |
|---|---|---|---|
| CN | 102669947 | A | 9/2012 |
| CN | 104433264 | A | 3/2015 |
| CN | 111256183 | A | 6/2020 |
| CN | 211582056 | U | 9/2020 |
| EP | 3072414 | A1 | 9/2016 |
| JP | 2006105470 | A | 4/2006 |
| KR | 1020080108204 | A | 12/2008 |

* cited by examiner

*Primary Examiner* — Ibrahime A Abraham
*Assistant Examiner* — Joseph W Iskra
(74) *Attorney, Agent, or Firm* — Paul J. Nykaza; Schacht Law Office, Inc.

(57) ABSTRACT

A heating table assembly (10) has a frame assembly (12) and a heating system (14). The frame assembly (12) has a base (16) and a support frame (18), the base (16) having an outlet opening (20). The heating system (14) is operably positioned in the frame assembly (12). The heating system (14) has a heating unit (70) connected to a duct assembly (72). The duct assembly (72) has an outlet (84) positioned at the outlet opening (20). The heating unit (70) generates heated forced air through the outlet opening (20) which is configured to provide warmth to a user positioned generally adjacent the outlet opening (20).

22 Claims, 14 Drawing Sheets

HEATING TABLE ASSEMBLY

CROSS-REFERENCE TO RELATED APPLICATIONS

The present application claims the benefit of U.S. Provisional Patent Application No. 63/142,584, filed on Jan. 28, 2021, which application is incorporated by reference in its entirety herein and made a part hereof.

FEDERALLY SPONSORED RESEARCH OR DEVELOPMENT

None.

TECHNICAL FIELD

The invention relates generally to a heating table assembly and, in particular, a heating table configured to be positioned on a support surface such as a patio where heated air is forced through an outlet of the table towards a user positioned adjacent the table to provide warmth to the user.

BACKGROUND OF THE INVENTION

Many people enjoy being outdoors such as home patios or in other commercial outdoor settings such as restaurants, cafes and bars. In outdoor settings, however, weather can become a factor in levels of enjoyment such as when experiencing cold, snow, wind, rain or heat.

Devices for regulating temperature in outdoor settings are known in the art. For example, fans or portable air conditioning units are used. In addition, patio heaters in the form of pole heaters, radiant heaters, infrared heaters or other types of heaters are sometimes used. Specific patio-type tables have also been designed to provide heated air or cooled air towards users sitting at the tables. These type of cooling and heating units are often highly expensive, cumbersome in design, lack efficiency or do not provide optimum comfort to users.

While such heating tables according to the prior art provide a number of advantageous features, they nevertheless have certain limitations. The present invention is provided to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention provides a heating table assembly.

According to a first aspect of the invention, the heating table assembly has a frame assembly and a heating system. The frame assembly has a base and a support frame, the base having an outlet opening. The heating system is operably positioned in the frame assembly. The heating system has a heating unit connected to a duct assembly. The duct assembly has an outlet member positioned at the outlet opening. The heating unit generates heated forced air through the outlet opening configured to provide warmth to a user positioned generally adjacent the outlet opening.

According to another aspect of the invention, the heating table assembly has a frame assembly and a heating system. The frame assembly is configured to be supported by a support surface. The frame assembly has a base and a support frame. The base has an outlet opening configured to be positioned adjacent the support surface. The heating system is operably associated with the frame assembly. The heating system has a heating unit connected to a duct assembly. The duct assembly has a duct outlet positioned at the outlet opening. The heating unit is capable of generating heated forced air through the outlet opening configured to provide warmth to a user positioned generally adjacent the outlet opening.

According to a further aspect of the invention, the frame assembly defines an internal space therein, and wherein the heating system is contained in the internal space.

According to another aspect of the invention, the base of the heating table assembly has a first longitudinal dimension and a first lateral dimension. The support frame has a second longitudinal dimension and a second lateral dimension. The second longitudinal dimension is greater than the first longitudinal dimension and the second lateral dimension is greater than the first lateral dimension. In such configuration, gap or vertical frame opening is defined between the support frame and base generally around a periphery of the base.

According to yet another aspect of the invention, the heating table assembly utilizes a temperature regulation system. The temperature regulation system is operably connected to the heating system wherein in response to the duct assembly reaching a predetermined temperature, the temperature regulation system provides a supply of cooling air to reduce the temperature of the duct assembly. The temperature regulation system has a temperature sensor connected to the duct assembly and a fan mounted on one of the frame assembly and the duct assembly. In response to the temperature sensor sensing a first predetermined temperature, the fan is activated wherein air is directed over the duct assembly to provide cooling to the heating system. Furthermore, in response to the temperature sensor sensing a second predetermined temperature, the fan is deactivated. In an additional aspect of the invention, the fan is mounted on the frame assembly and directs air over a top surface of the duct assembly and wherein the air passes through a vertical frame opening defined between the support frame and the base. In a further aspect, the temperature sensor is mounted on a top surface of the duct assembly and generally proximate the heating unit.

According to another aspect of the invention, the heating table assembly utilizes a damper member. The damper member is positioned in the outlet opening wherein the damper member has a closed configuration and an open configuration According to another aspect of the invention, the support frame defines an end frame member. The end frame member supports a removable access panel providing access to the heating system.

According to another aspect of the invention, the heating table assembly has a burner assembly supported on a top surface of the support frame. The burner assembly is operably connected to the heating unit, and the burner assembly provides an aesthetic flame member.

According to yet another aspect of the invention, the heating table assembly utilizes a heat capture assembly. The assembly has a blanket having a proximal end removably attached to a top surface of the support frame. A free distal end of the blanket is configured to cover a user's legs positioned generally adjacent to the heating table assembly wherein heated forced air through the outlet opening is contained under the blanket. The support frame defines a top surface wherein the top surface has a metal member operably connected thereto proximate a peripheral edge of the top surface. The blanket has a magnet member operably connected to the proximal end of the blanket, wherein the magnet is removably attached to the metal member. In a further aspect, the metal member is embedded in the top surface, and the magnet is positioned within a seam of the blanket at the proximal end of the blanket. The magnet is attracted to the metal member through the blanket and top surface. In still a further aspect, the metal member is embedded in the top surface around a full periphery of the top surface.

According to a further aspect of the invention, the heating unit is a propane heating unit having an internal burner and an internal fan. The burner is configured to be operably connected to a fuel source and the internal fan is configured to be operably connected to a power source wherein the heating unit generates heated forced air to the duct assembly.

According to another aspect of the invention, a heating table assembly has a frame assembly, a heating system and a temperature regulation system. The frame assembly is configured to be supported by a support surface. The frame assembly has a base and a support frame. The base has an outlet opening configured to be positioned adjacent the support surface. The heating system is operably associated with the frame assembly. The heating system has a heating unit connected to a duct assembly. The duct assembly has a duct outlet positioned at the outlet opening. The heating unit is operably connected to a fuel source and a power source and is capable of generating heated forced air through the outlet opening. The temperature regulation system is operably connected to the power source and has a temperature sensor and a cooling assembly. The temperature sensor is operably connected to the cooling assembly. The temperature sensor is positioned on the duct assembly and the cooling assembly is operably associated with the duct assembly. The heating system generates heated forced air into the duct assembly wherein the heated forced air exits through the outlet opening of the base. In response to the temperature sensor sensing a first predetermined temperature, the cooling assembly is activated wherein air is directed over the duct assembly to provide cooling to the heating system. In response to the temperature sensor sensing a second predetermined temperature, the cooling assembly is deactivated. The air exiting the outlet opening is configured to provide warmth to a user positioned generally adjacent the outlet opening.

According to yet another aspect of the invention, a vertical frame opening is defined between the base and the support frame. The air directed over the duct assembly exits through the vertical frame opening. The cooling assembly comprises a fan mounted on the frame assembly and generally adjacent to the duct assembly. The temperature sensor has a heat sensor relay wherein upon sensing the first predetermined sensor the heat sensor relay connects the cooling assembly to the power source to activate the cooling assembly, and wherein upon sensing the second predetermined sensor the heat sensor relay disconnects the cooling assembly from the power source to deactivate the cooling assembly.

According to yet another aspect of the invention, the heating table assembly has a frame assembly, a heating system and a temperature regulation system. The frame assembly is configured to be supported by a support surface. The frame assembly has a base and a support frame collectively defining an internal space. The base has a first side beam member and a second side beam member spaced by and connected to a first end beam member and a second end beam member. The side beam members and the end beam members define a plurality of outlet openings therein configured to be positioned adjacent the support surface. The support frame has a first side frame and a second side frame spaced by and connected to a first end frame and a second end frame. The support frame further has a top planar member. The support frame is connected to the base by a plurality of cross-members, wherein the support frame extends beyond the base to define a vertical frame opening between the base and the support frame. The heating system is positioned in the internal space of the frame assembly. The heating system has a heating unit connected to a duct assembly. The duct assembly has a plurality of duct outlets, one of the plurality of duct outlets positioned at a respective one of the plurality of outlet openings. The heating unit has a burner operably connected to a fuel source and an internal fan operably coupled to a power source, the heating unit generating heated forced air into the duct assembly and through the outlet openings. The temperature regulation system has a temperature sensor and a fan. The temperature sensor has a heat sensor relay and is operably connected to the fan. The temperature sensor is positioned on a top surface of the duct assembly and the fan is positioned on the support frame generally adjacent the duct assembly. The heating system generates heated air forced into the duct assembly wherein the heated forced air exits through the outlet openings of the base. In response to the temperature sensor sensing a first predetermined temperature, the heat sensor relay connects the fan to the power source wherein the fan is activated wherein air is directed over the duct assembly to provide cooling to the heating system wherein air directed from the fan exits through the vertical frame opening. In response to the temperature sensor sensing a second predetermined temperature, the heat sensor relay disconnects the fan from the power source wherein the fan is deactivated. The air exiting the outlet openings and frame opening is configured to provide warmth to a user positioned generally adjacent the outlet openings.

According to yet another aspect of the invention, the end beam members of the base define a respective outlet opening therein, and the side beam members defining a respective plurality of outlet openings therein. Each outlet opening of the side beam members has a damper member therein. Each damper member has an open configuration allowing heated forced air to pass therethrough and a closed configuration obstructing heated forced air from passing therethrough. The outlet openings in the end beam members are unobstructed.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION OF THE PREFERRED EMBODIMENTS

Figure 1:
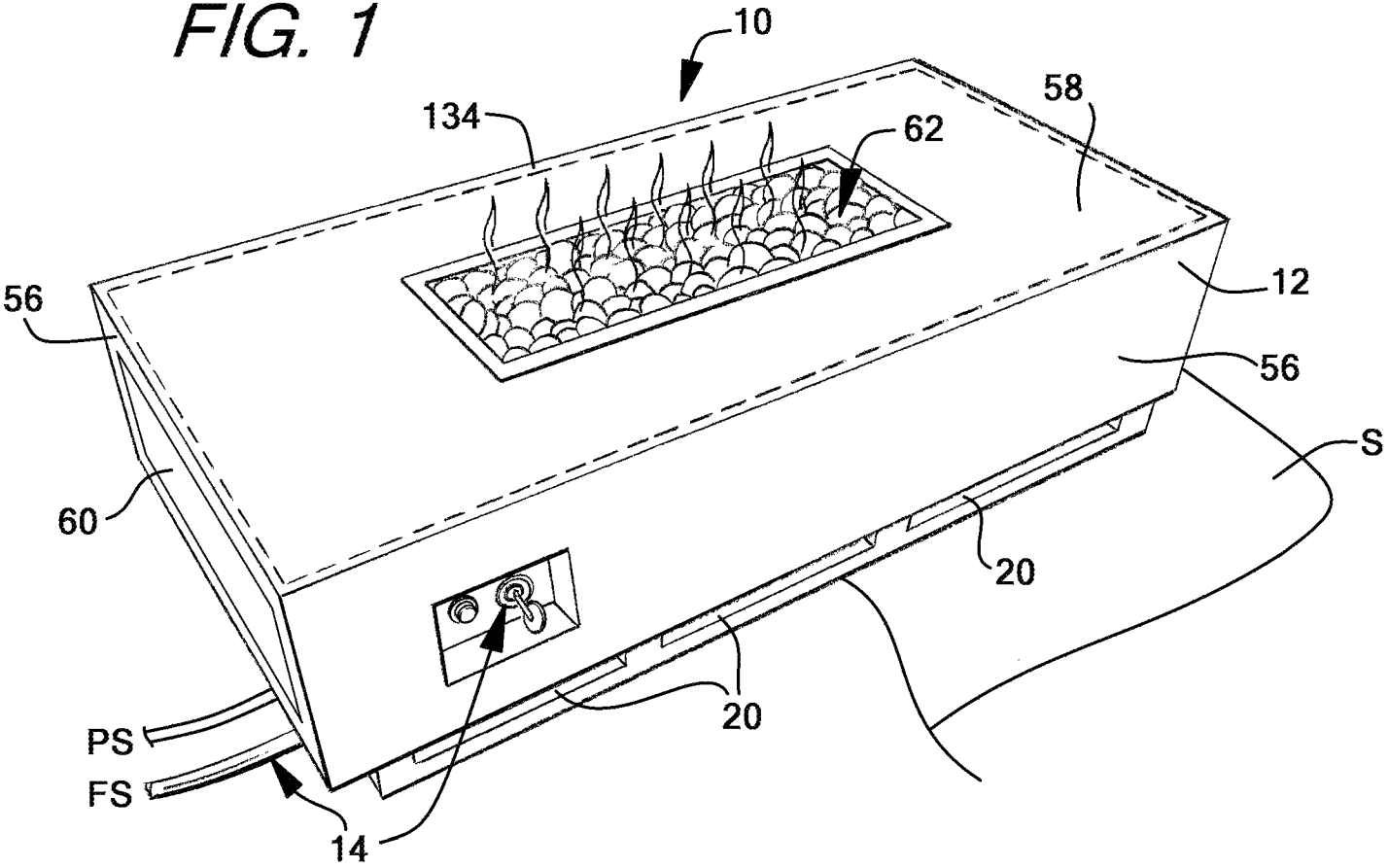
FIG. 1 is a perspective view of a heating table assembly according to an exemplary embodiment of the present invention.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to the drawings, FIG. 1 shows a perspective view of a heating table assembly according to an exemplary embodiment of the present invention, generally designated with the reference numeral 10. As further shown in FIGS. 1-14, the heating table assembly 10 generally includes a frame assembly 12 and a heating system 14. As explained in greater detail below, it is understood that the heating system 14 can cooperate with various fuel-related and electrical-related components for controlling operation of the heating system 14 and other systems/components associated with the heating table assembly 10. The structure of the heating table assembly 10 will be described herein followed by a description of general operation of the heating table assembly 10.

FIGS. 1-4 show the frame assembly 12 in greater detail. The frame assembly 12 generally includes a base 16, or base member 16, and a support frame 18. As discussed in further detail below, the base 16 and the support frame 18 are operably connected together wherein the support frame 18 is supported on the base 16.

The base 16 has a plurality of frame members wherein the base 16 of the frame assembly 12 will define an outlet opening 20 to be described in greater detail below. The frame members include a first side beam member 22 and a second side beam member 24 spaced by a first end beam member 26 and a second end beam member 28. The side beam members 22,24 and the end beam members 26,28 are connected together generally at respective ends and define an internal space 30 within the beam members 22-28. In an exemplary embodiment, the interconnected frame members of the base 16 have a generally rectangular shape. Other shapes are also possible based on the dimensions and/or configuration of the beam members 22-28. As explained in greater detail below, the support frame 18 will cooperate with the base 16 to also cooperatively define the internal space 30. As also further described below, the internal space 30 will accommodate and receive the heating system 14. In an exemplary embodiment, the heating system 14 is completely contained within the internal space 30 and enclosed within the internal space 30 via the panels and table top member to be described. As further shown in FIG. 4, the first side beam member 22 is spaced from the second side beam member 24 to define a first lateral distance LA1 of the base 16. The first end beam member 26 is spaced from the second end beam member 28 to define a first longitudinal distance LO1 of the base 16.

As further shown in FIGS. 2-5, the first side beam member 22 and the second side beam member 24 have an outlet opening 32 defined therein. The outlet openings 32 correspond to the outlet opening 20 of the frame assembly. In an exemplary embodiment, a plurality of outlet openings 32 are defined therein and in a further exemplary embodiment, three outlet openings 32 are defined in adjacent fashion along each side beam member 22,24. In addition, each end beam member 26,28 has an outlet opening 32 defined therein. It is understood that the number of outlet openings 32 in the members can vary as desired. Thus, the outlet opening 32 in the side beam members 22,24 can be a single elongated opening or a plurality of outlet openings 32, and a plurality of outlet openings 32 can be defined in the end beam members 26,28.

Figure 3:
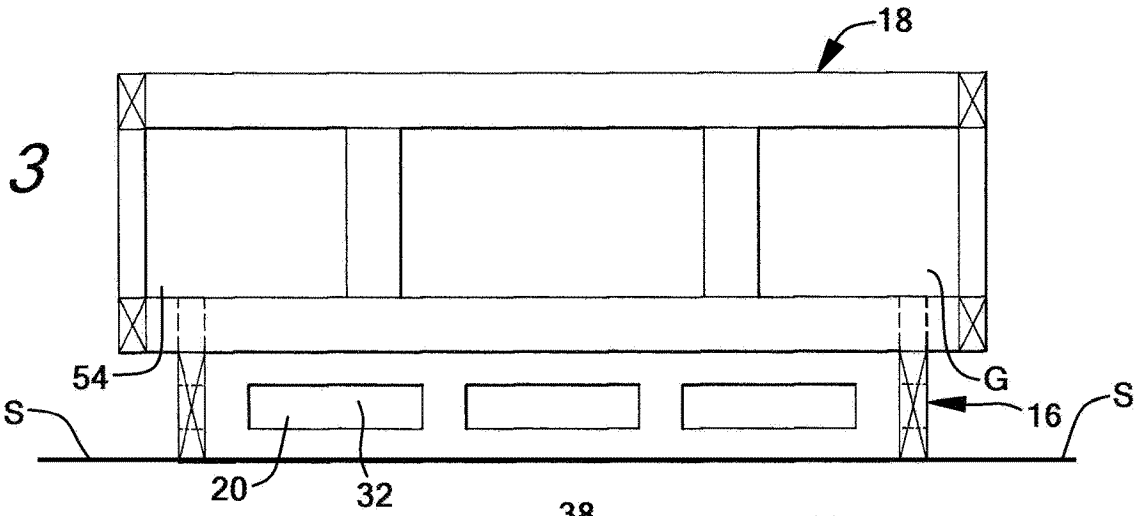
FIG. 3 is a side elevation view of the frame assembly of FIG. 2.
Figure 5:
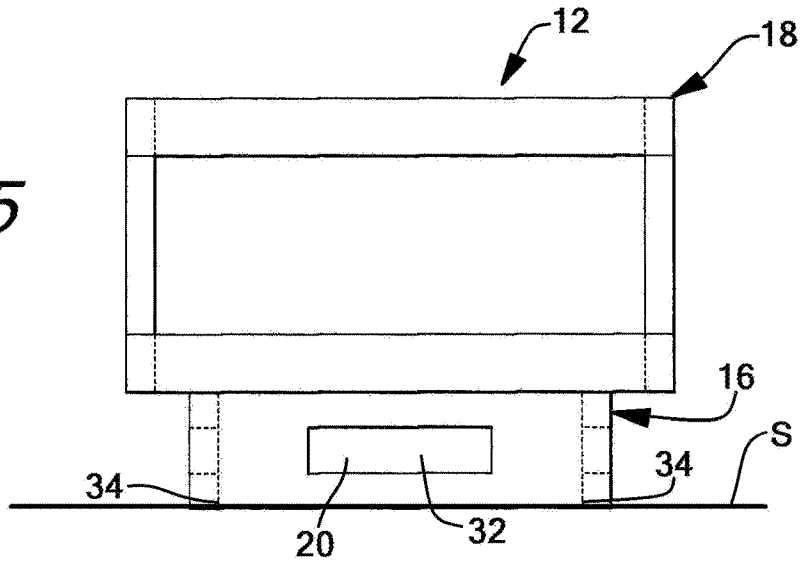
FIG. 5 is an end elevation view of the frame assembly of FIG. 2.

As described in greater detail below, the base 16 is designed to rest on a support surface S such as the ground or patio surface (FIGS. 1, 3 & 5). The support surface S can further take other forms depending on the location of the heating table assembly 10. The base 16 may utilize footer members 34 (FIG. 5) that are designed to rest on a ground or support surface S. The footer members 34 assist in stabilizing and leveling the heating table assembly 10.

The base 16 can be made from various materials suitable to support other components of the heating table assembly 10. In one exemplary embodiment of the application, the individual beam members of the base 16 are made from wood. In a further exemplary embodiment, the beam members are generally 2×6 members, understanding general dimensions can vary.

Figure 9:
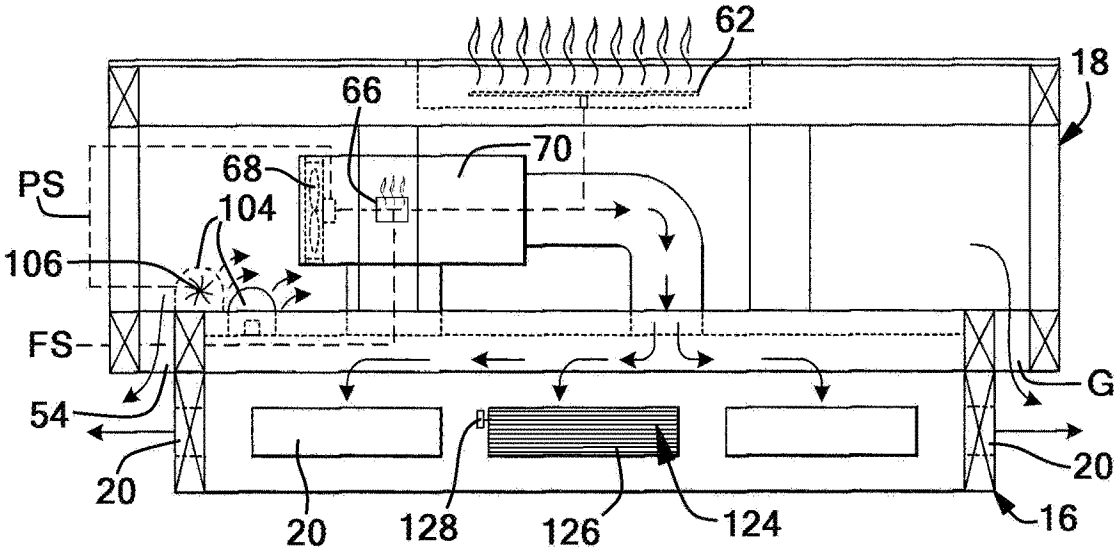
FIG. 9 is a side elevation view of the heating table assembly of FIG. 1 with portions of the support frame removed to show an internal space of the frame assembly to expose the heating system.

The outlet openings 20 in the base 16 are shown as generally unobstructed. As shown in FIG. 9, it is contemplated that the heating table assembly 10 can utilize a damper member 124 over the outlet opening 20. The damper member 124 has moveable flaps 126 or slats 126 to provide an open configuration and a closed configuration by a user positioned generally adjacent the outlet opening 20. The damper member 124 may also have a lever 128 operably connected to the moveable flaps 126. In use, a user may engage the lever 128 via a foot or hand to place the damper member 124 in a closed configuration or an open configuration. In the open configuration, heated forced air can pass through the outlet opening 20. In the closed configuration, heated forced air is obstructed from passing through the outlet opening. In an exemplary embodiment where a damper member 124 is utilized, the outlet openings 20 positioned along the first side beam member 22 and the second side beam member 24 have a damper member 124 positioned therein. The outlet openings 20 positioned on the first end beam member 26 and the second end beam member 28 always remain in an unobstructed configuration with no damper member 124 therein. In this configuration, heated forced air through the outlet openings could be controlled or regulated through the sides of the heating table assembly 10. Heated forced air is always free to pass through the outlet openings 20 at respective ends of the heating table assembly 10. In such configuration, heated air cannot build up within the internal space 30 wherein the heating system 14 could experience overheating and wherein external surfaces on the heating table assembly including the table-top member could reach a higher temperature than desired. Thus, an undesired elevated temperature condition is avoided.

FIGS. 2-5 further show the support frame 18. In an exemplary embodiment, the support frame 18 is a box-like structure supported by the base 16. The support frame 18 includes a first side frame 36 and a second side frame 38 spaced by a first end frame 40 and a second end frame 42. It is understood that in an exemplary embodiment, the side frames 36,38 and end frames 40,42 are generally square/rectangular shaped and made up of individual, interconnected members. Thus, each frame has an upper horizontal member 44, a lower horizontal member 46 connected by a first vertical side member 48 and a second vertical side member 50. It is understood that the vertical side members 48,50 can cooperate to form parts of the side frames 36,38 and end frames 40,42. As can be appreciated from FIG. 2, the side frames 36, 38 may utilize additional vertical support members 49. The side frames 36,38 and the end frames 40,42 are connected together generally at respective ends in a generally rectangular shape. As explained in greater detail below, the frames 36,38,40,42 are also configured to receive a covering, or panel member, that will form an outer surface of the heating table assembly. It is further understood that the frames 36,38,40,42 cooperate to support a table top member of the heating table assembly 10.

Figure 2:
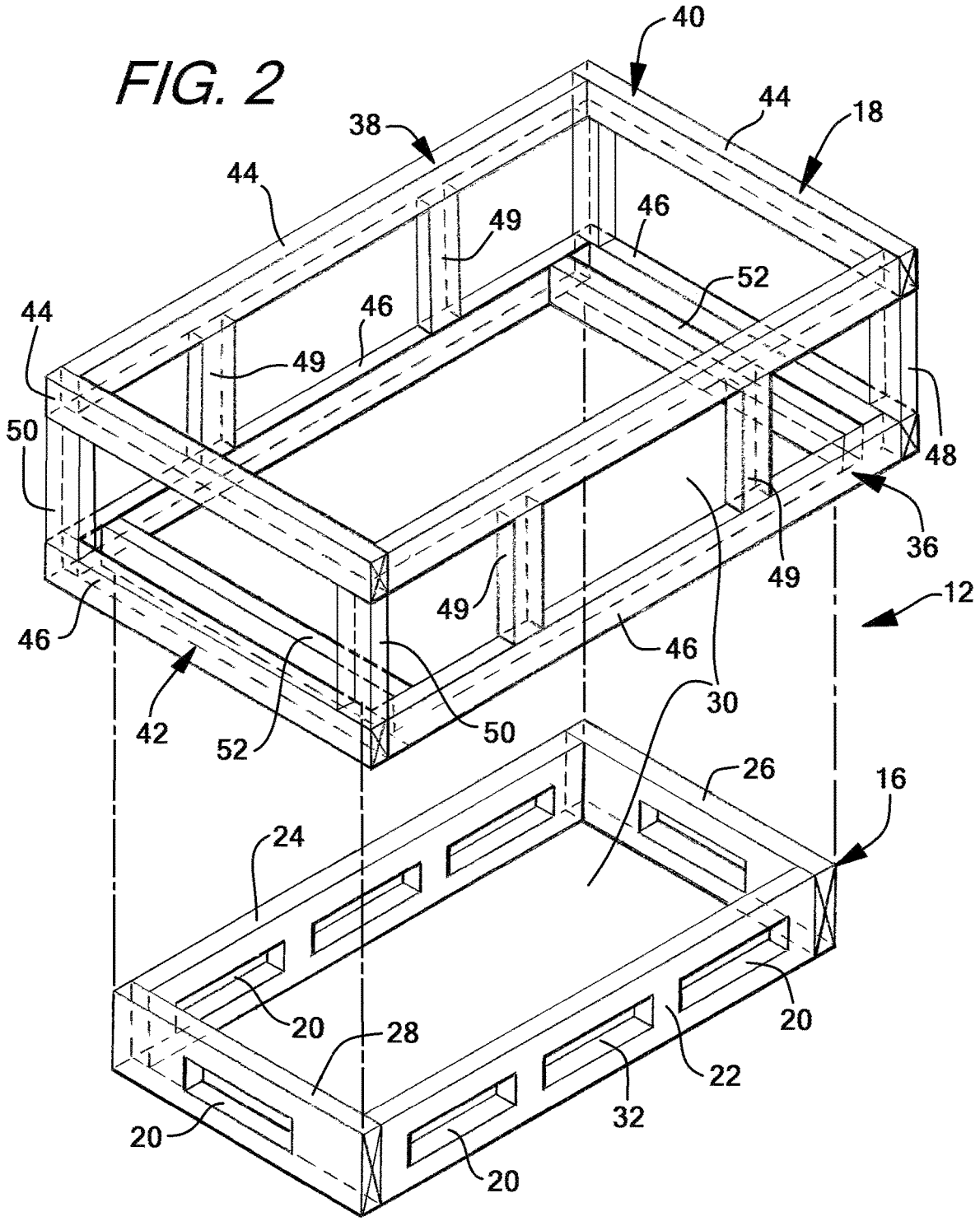
FIG. 2 is a perspective exploded view of a frame assembly of the heating table assembly.
Figure 2A:
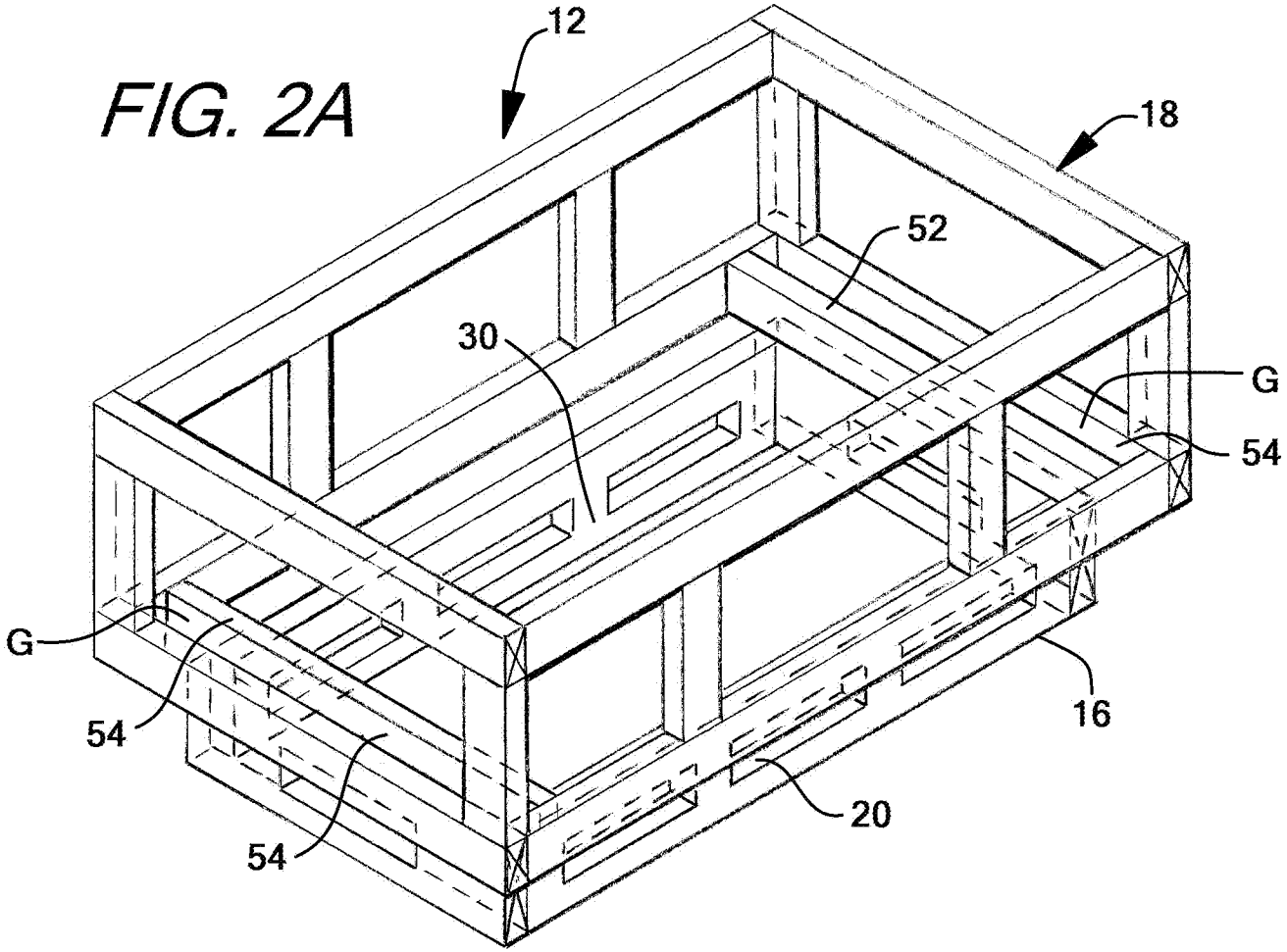
FIG. 2A is a perspective view of the frame assembly of FIG. 2 showing a base connected to a support frame by cross members.

As can be appreciated from FIGS. 2 and 2A, the support frame 18 cooperates with the base 16 to cooperatively define the internal space 30 within the frames 36,38,40,42 and base 16. As described in greater detail below, the internal space 30 accommodates the heating system 14 and other components of the heating table assembly 10. As further shown in FIG. 4, the first side frame 36 is spaced from the second side frame 38 to define a second lateral distance LA2 of the support frame 18. The first end frame 40 is spaced from the second end frame 42 to define a second longitudinal distance LO2 of the support frame 18.

As discussed, and shown in the figures, the support frame 18 is operably connected to the base 16. In an exemplary embodiment, the support frame 18 is connected to or supported on the base frame by a plurality of cross members 52. The support frame 18 may be considered to have the plurality of cross-members 52 extending between the first side frame 36 and the second side frame 38. As shown in FIGS. 2 and 2A, the cross-members 52 are a pair of cross-members 52 in an exemplary embodiment and are positioned generally within the end frames 40,42. It is understood that more or less cross members 52 may be used to operably connect the base 16 and support frame 18, which may depend on the overall dimensions of the heating table assembly 10. As described in greater detail below, the cross members 52 are designed to be operably connected to the end beam members 26,28 of the base 16. The cross members 52 have a length extending past the length of the end beam members 26,28 of the base 16. As can be appreciated from FIGS. 2 and 2A, the cross members 52 engage a top of the end beam members 26,28 and are operably connected thereto such as by suitable fasteners. It is also understood that the frame members 36,36,40,42 are dimensioned at a height greater than a height of the base 16. The combined overall height of the base 16 and the support frame 18 generally defines the height of the table assembly 10. It is understood that the support frame 18 and cross members 52 can be made from similar materials as the base 16. In an exemplary embodiment, the support frame 18 and cross members 52 are also made from wood beam members such as 2×4 members in certain exemplary embodiments.

Figure 4:
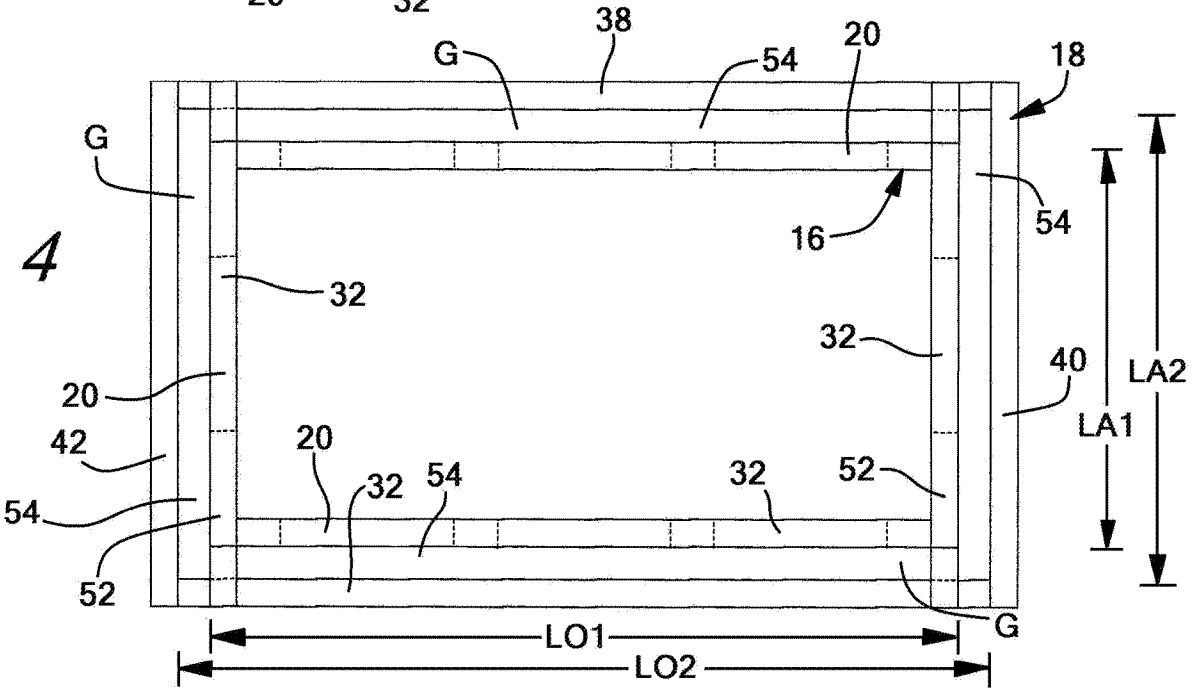
FIG. 4 is a top plan view of the frame assembly of FIG. 2.

As also described in greater detail below and shown generally in FIGS. 3-5, the second lateral distance LA2 is greater than the first lateral distance LA1. The second longitudinal distance LO2 is greater than the first longitudinal distance LO1. This configuration defines a peripheral gap G, or vertical outlet opening 54, or vertical frame opening 54. In an exemplary embodiment, the gap G, vertical outlet opening 54 or vertical frame opening 54 extends generally around a periphery of the heating table assembly 10. It is understood that ends of the cross members 52 interrupt the gap G, or vertical outlet opening 54 proximate corners of the frame assembly 12. The vertical outlet opening is further shown in FIG. 10A.

As discussed, the base 16 and support frame 18 cooperatively define the internal space 30 to accommodate the heating system 14 and other components. The frame members 36,38,40,42 can also define generally planar side/end surfaces 56 that cooperate to generally enclose the internal space 30 as can be appreciated from FIG. 1. In addition, the support frame 18 also supports a table top member 58 (FIG. 1) of the table assembly 10 to be further described below.

Thus, the planar side/end surfaces 56 generally define wall-forming surfaces. For example, each of the first side frame 36, the second side frame 38, the first end frame 40, the second end frame 42, and table top member 46 can support planar surfaces that receive plaster-type materials to form planar side walls. The table top member 58 of the heating table assembly 10 can also form surfaces similar to the side surfaces 56. In one exemplary embodiment, the planar side/end surfaces 56 and the table top member 58 can be formed from plaster-type materials. Other materials for forming the walls can also be used in addition to plaster-type materials including lightweight concrete materials, stucco materials, composite materials or polymer-based materials. Glass-fiber reinforced materials can be used or materials having Styrofoam additives for weight reduction can be used. It is further understood that the frame assembly 12 can be made from metal materials or wood slats or wood beam members. The frame assembly can also be combinations of materials discussed above.

As described in greater detail below, one of the end frames 40,42 can include a removable access panel 60 (FIG. 1) that provides access into the internal space 30 through the end frame 40,42. Access can also be provided in one of the side frames 36,38 and or even the table top member 58 if desired. As also described in greater detail below, the table top member 58 may also operably support a table top burner assembly 62 (FIGS. 1 and 6) to provide a generally aesthetic flame, which may also provide a certain amount of warmth to users as well.

As further shown in FIGS. 6-11, the heating system 14 generally includes a heating unit 70 and a duct assembly 72. As explained in greater detail below, the heating table assembly 10 may also include a temperature regulation system 74 that is associated with the heating system 14 in an exemplary embodiment. As described in greater detail below, the heating table assembly 10 may utilize various fuel and power components that cooperate and used to control the heating system 14 and the temperature regulation system 74. As also described in greater detail below, the heating system 14 is operably connected to the frame assembly 12 and contained within the internal space 30 in an exemplary embodiment. As discussed, in an exemplary embodiment, the heating system 14 is entirely positioned within the internal space 30 collectively defined by the base 16 and the support frame 18.

Figure 13:
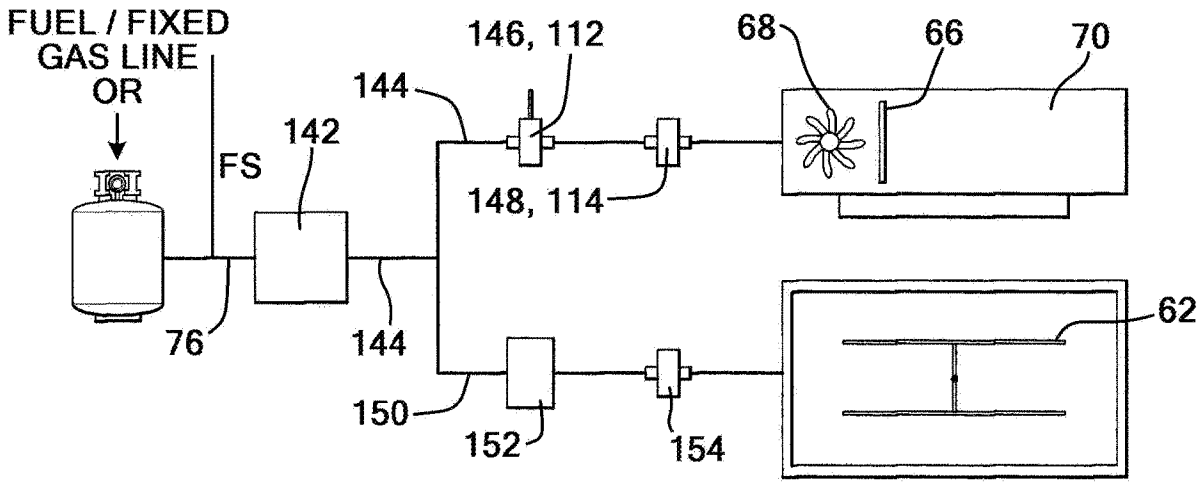
FIG. 13 is a fuel schematic diagram for the heating table assembly of FIG. 1.

As further shown in FIGS. 6-11, the heating unit 70 is generally a propane forced air heater known in the art in one exemplary embodiment. The heating unit 70 has an internal burner 66 and an internal fan 68. The internal burner 66 or burner assembly is suitable for burning a supply of fuel such as propane or natural gas. It is understood that internal fan 68 has an associated motor that turns the fan 68 to circulate air across the burner to create heated forced air. The propane heater is configured to be operably connected to a fuel source FS, which can take various forms. For example, the propane heater 70 may utilize an inlet fuel hose 76 (FIG. 1) that connects to a fuel tank (FIG. 13) or a permanent fuel source (FIG. 13). The propane heater 70 further utilizes the internal fan 68 positioned generally within the heating unit 70 as known in the art. The internal burner 66 is operably connected to the fuel source FS to burn fuel and wherein the internal fan 68 forces heated air from the heating unit 70. The heating unit 70 further has a power inlet 78 (FIG. 1) operably connected thereto and connected to a power/electrical source PS to provide power to the internal fan 68 and other components. While the heating unit 70 is a forced air propane heater known in the art in one exemplary embodiment, the heating unit 70 can take other forms. For example, the heating unit 70 can be a unit that burns other types of fuel. Thus, the heating unit 70 could be a natural gas burner and the fuel source could be a natural gas source. Other fuels types and burners are also possible.

The heating unit 70 further utilizes a duct assembly 72 that is generally in fluid communication with an outlet of the heating unit 72 and the outlet opening 20 of the base 16. The duct assembly 72 generally includes an inlet duct member 80, a plenum duct member 82 and an outlet duct member 84.

Figure 6:
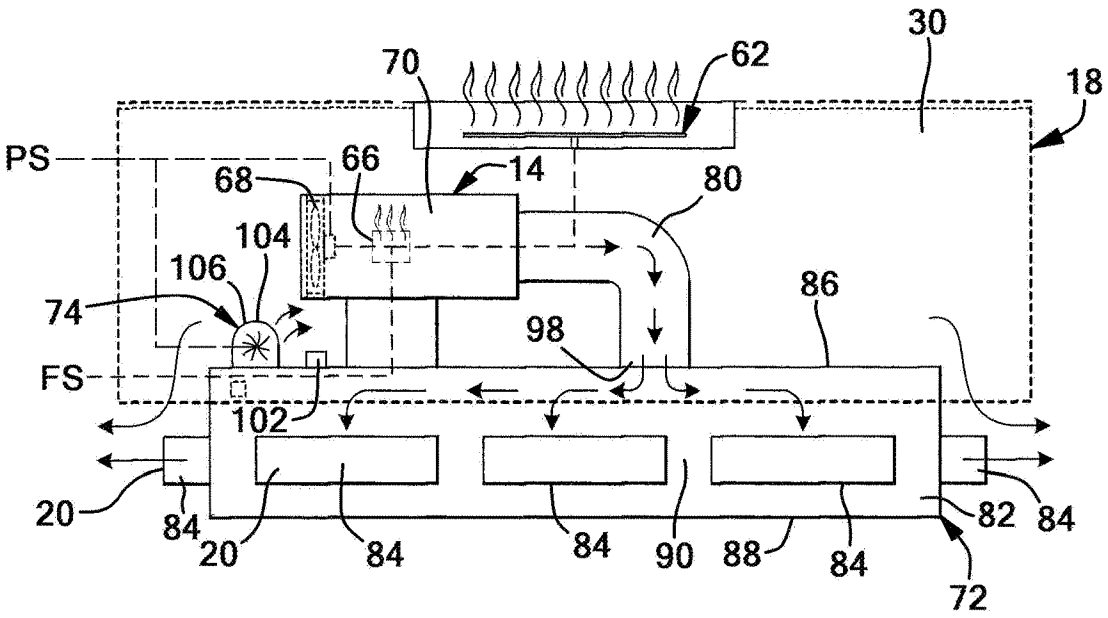
FIG. 6 is a schematic side elevation view of a heating system of the heating table assembly, a portion of the frame assembly shown schematically.
Figure 7:
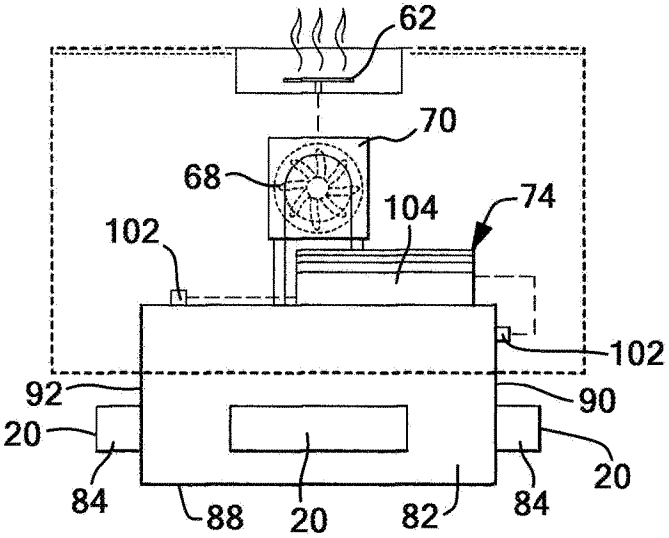
FIG. 7 is a schematic end view of the heating system, a portion of the frame assembly shown schematically.
Figure 8:
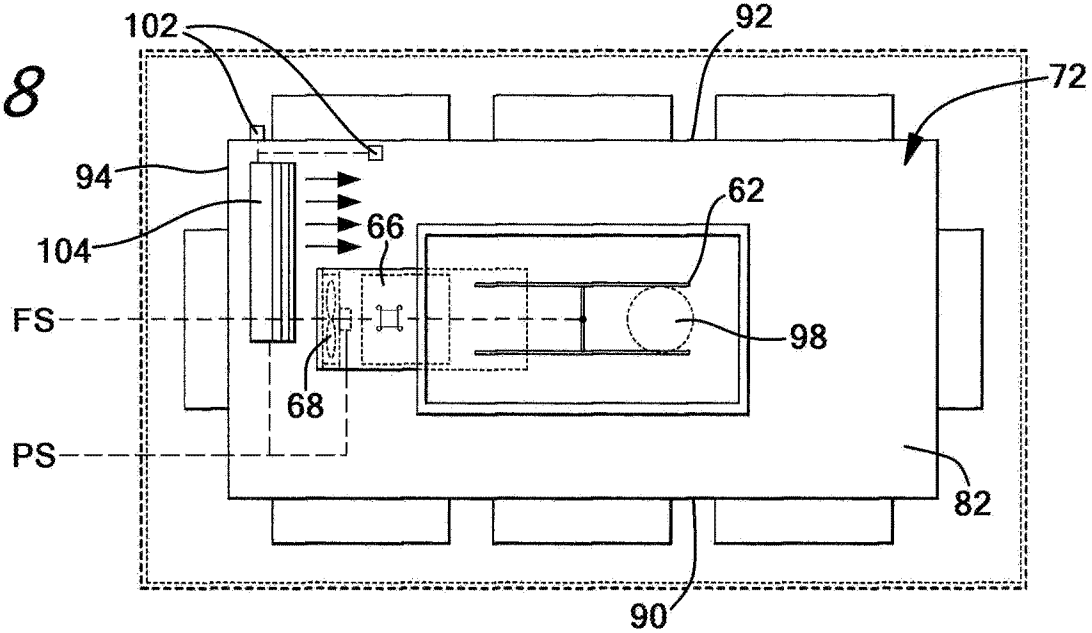
FIG. 8 is a schematic top plan view of the heating system, a portion of the frame assembly shown schematically.

As further shown in FIGS. 6-8, the inlet duct member 80 is generally a conduit member having an approximate 90-degree bend as shown in FIG. 6. The inlet duct member 80 connects the outlet of the heating unit 70 to the plenum duct member 82. In one exemplary embodiment, the inlet duct member 80 is an approximately 8-inch member having the approximate 90-degree bend that is operably connected to a central portion of the plenum duct member 82 as described in greater detail below. The inlet duct member 82 has a generally circular cross-section in one exemplary embodiment. It is understood, however, that the inlet duct member 82 could have other configurations such as to operably connect to an outlet of various heating units 70. The inlet duct member 80 is also mechanically connected to the outlet of the heating unit 70 and the plenum duct member 82 by various mechanical fasteners known in the art. Sheet metal screws can be used as well as aluminum foil tape.

The plenum duct member 82 is generally a box-shaped member also made of metal duct material in one exemplary embodiment, and may be considered an intermediate member between the inlet duct member 80 and the outlet duct member 84. The plenum duct member 82 is dimensioned to generally fit within the base 16, and within the internal space 30. In one exemplary embodiment, the plenum duct member 84 is a generally box-shaped member and having a generally rectangular cross-section. Thus, the plenum duct member 84 has a top surface 86, a bottom surface 88, a first side surface 90, a second side surface 92, a first end surface 94 and a second end surface 96. It is understood that the side surfaces 92,94 oppose one another and the end surfaces 94,96 oppose one another. The surfaces 86-96 of the plenum duct member 82 cooperate to define an interior of the plenum duct member 82. It is understood that the plenum duct member 82 could take other shapes or configurations. An inlet opening 98 is defined in the top surface 86 of the plenum duct member 82. The inlet duct member 80 is operably connected to the plenum duct member 82 at the inlet opening 98. The inlet opening 98 of the plenum duct members 82 is positioned generally at a central location, or middle location of the top surface 86 of the plenum duct member 82 (FIG. 8). The plenum duct member 82 also has a plurality of duct extensions or outlet duct members 84. The duct extensions 84 extend from the side surfaces 90,92 and the end surfaces 94,96 of the plenum duct member 82. The outlet duct members 84 are received by, cooperate with, and correspond to the outlet openings 20 of the base 16 as can be appreciated from FIGS. 9-11. It is understood that the plenum duct member 82 could also open directly to the outlet opening 20 of the base 16. It is also understood that the various duct inlets and outlets can be positioned in other surfaces of the plenum duct member 82. As discussed, the plenum duct member 82 is made from a metal material in an exemplary embodiment. In addition, the plenum duct member 82 can come in various sizes. In one exemplary embodiment, the plenum duct member 82 is generally approximately 48 inches in length, 24 inches in width and 8 inches in height, and fits snugly within the base 16.

As discussed, the outlet duct members 84 extend from the plenum duct member 82 and are dimensioned to fit into and generally received by the outlet openings 20 of the base 16. It is understood that the outlet duct members 84 could also be positioned generally adjacent to the outlet openings 20. It is further understood that the outlet duct members 84 could not employ an extension configuration and merely define an outlet opening in the plenum duct member 82. The outlet duct members 84 extend generally normal to the side surfaces 90-96 of the plenum duct member 82. As described, there are three outlet duct members 84 on each longitudinal side of the plenum duct member 84 and a single outlet duct member 84 on each end of the plenum duct member 84. The outlet duct members 84 are generally 2 inches in height and 12 inches in length. Distal ends of the outlet duct members 66 are generally flush with the planar surfaces of the base 16, although the distal ends could be recessed within the outlet openings 20 of the base 16 or extend past the outlet openings 20 of the base 16. As can be appreciated from the above description, the duct assembly 72 provides fluid communication from the output of the heating unit 70, through the inlet duct member 80, through the plenum duct member 82, and through the outlet duct member 84 and outlet opening 20 of the base 16. It is understood that the duct assembly 72 is described in an exemplary embodiment as having multiple components. In additional forms of the duct assembly 72, the heating unit 70 could be considered to have an outlet member that is directly connected to and in communication with the plenum duct member 82 of the duct assembly 72. In addition, the plenum duct member 82 could be formed having an outlet in direct communication with the outlet opening 20 of the frame assembly 12 wherein the outlet duct member 84 is not utilized.

As further shown in FIGS. 6-11, the heating system 14 also utilizes a temperature regulation system 74. As the heating unit 70 generates considerable heat, the temperature regulation system 74 assists in preventing overheating of the heating unit 70 and the heating table assembly 10 such as the planar side/end surfaces 56 and table top member 58. In general, the temperature regulation system 74 functions to sense for a first predetermined temperature associated with the heating table assembly 10, and heating system 14 in particular, wherein when sensed, the system 74 is activated to lower the sensed temperature. In addition, when the system 74 senses a second predetermined temperature, the system 74 deactivates the temperature-lowering operation.

The temperature regulation system 74 generally includes a temperature sensor 102 operably coupled to a cooling assembly 104, which in an exemplary embodiment is a blower fan 104 such as a squirrel-cage fan known in the art. It is understood that the blower fan 104 has an associated motor for turning impellers of the fan 104 to move air for cooling the duct assembly 72 and heating unit 70. As can be appreciated from FIG. 6 and FIG. 10A, the blower fan 104 has a plurality of rotating impeller members 106 that move air when the blower fan is activated. It is understood that the temperature regulation system 74 is also operably coupled to the electrical components used to power the heating system 14 such that power is provided to the temperature sensor 102 and the cooling assembly 104. Thus, as described in greater detail below, the blower fan 104 is operably connected to the power source PS as well as the temperature sensor 102.

The temperature sensor 102 senses a temperature associated with the heating table assembly 10. In particular, the temperature sensor 102 senses the temperature of the metal of the plenum duct member 82 of the heating system 14. The temperature sensor 102 is operably connected on the surface of the plenum duct member 82 such as being positioned on the top surface 86 of the plenum duct member 82. It is understood that the temperature sensor 102 could also be positioned on the side surfaces 90,92 of the plenum duct member 82 or other surfaces of the duct assembly 72. FIG. 8 shows the temperature sensor 102 located either on the top surface 86 or the side surface 92 although it is understood that a single temperature sensor 102 is utilized in an exemplary embodiment. The temperature sensor 102 has magnetic characteristics in an exemplary embodiment and thus is removably attached to the duct assembly 82 and thus could be easily repositioned on the top surface 86 of the plenum duct member 82 or moved to a side surface 90,92 as desired. In other exemplary embodiments, multiple temperature sensors 102 operably connected could be utilized. In one exemplary embodiment, the temperature sensor 102 is positioned on the top surface 86 proximate a location on a longitudinal length of the plenum duct member 82 proximate to where the heating unit 70 is positioned on the plenum duct member 82. It is understood that the temperature sensor 102 can be located at other locations of the heating assembly 14 or heating table assembly 10. In a further exemplary embodiment, the temperature sensor 102 is a magnetic temperature sensor, or thermostat type temperature sensor. The temperature sensor 102 may also be referred to as a thermostat on/off switch. The temperature sensor 102 utilizes a heat sensor relay 103 (FIG. 14) as known in the art, which through operable electrical connections activates and deactivates the cooling assembly 104 as described further below. Such temperature sensors 102 are commercially-available to those skilled in the art through various different distribution channels. It is understood that other types of temperature sensors may also be used. For example, a temperature sensor 102 not having the magnetic properties could be affixed to the duct assembly 72 using other fastening methods. While the temperature sensor 102 senses a surface temperature of the duct assembly 72 in one exemplary embodiment, the temperature sensor 102 could be designed to sense an air temperature within the duct assembly 72 or outlet of the heating unit 70. Such configuration could lead to increased cycling of the cooling assembly 104 wherein the surface mounted temperature sensor 102 provides a configuration to desirably control temperature without undue cycling of the cooling assembly 104. Other configurations are also possible that could protect overheating.

As discussed, the cooling assembly 104 takes the form of the blower fan 104 in an exemplary embodiment. Other mechanisms/components could also be used for cooling. The blower fan 104 is positioned at an end of the plenum duct member 82 and generally adjacent to the heating unit 70. It is understood that the blower fan 104 could be sized to extend all the way across the plenum duct member 82. The blower fan 104 is operably connected to the temperature sensor 102, and is configured to receive electrical power from the power source PS for the heating table assembly 10. In an exemplary embodiment, the blower fan 104 is a squirrel-cage type fan although other types of fans can also be used. Thus, the blower fan 104 has the plurality of rotating impeller members 106 that rotate to move air. The blower fan 104 is configured to direct air across the top surface 86 of the plenum duct member 82. As described in greater detail below, the temperature regulation system 74 is designed to activate or turn on the blower fan 104 when the temperature sensor 102 senses a first predetermined temperature and also designed to deactivate or turn off the blower fan 104 when the temperature sensor 102 senses a second predetermined temperature. In one exemplary embodiment of the present invention, the temperature regulation system 74 is configured such that the first predetermined temperature is a high temperature setting of 120°, and such that the second predetermined temperature is a lower temperature setting of 90°. Thus, when the temperature sensor 102 senses the first predetermined temperature of 120°, the heat sensor relay 103 associated with the temperature sensor 102 closes the electrical circuit which turns on or activates the blower fan 104 (as can be appreciated from FIG. 14). The blower fan 104 directs air over the duct assembly 72, and in particular over the top surface 86 of the plenum duct member 82, which cools the duct assembly 72 and lowering overall temperature. When the temperature sensor 102 senses the second predetermined temperature of 90°, the heat sensor relay 103 associated with the temperature sensor 102 opens the electrical circuit which turns off or deactivates the blower fan 104. When the blower fan 104 is activated, the fan 72 blows air generally along the length of the top surface 86 of the plenum duct member 82 such as shown schematically in FIGS. 6, 8 and 9. In such configuration, the blower fan 104 helps to remove heated air from the plenum duct member 82 and internal space 30 through the gap G or frame opening 54. The heat air removed can also be felt by a user sitting at the table assembly 10 as further described below. It is understood that when the heating table assembly 10 is in operation, the blower fan 104 continuously cycles between a deactivated configuration and an activated configuration depending on the temperature sensed by the temperature sensor 102. As explained in greater detail below, the operation of the temperature regulation system 74, minimizes the chance for the heating unit 70 from overheating or the overall temperature in the internal space 30 becoming too high or external surfaces 56 of the heating table assembly 10 including the table top member 58 from becoming too hot to the touch of a user. As discussed, the temperature sensor 102 is selected such that the sensor senses the first predetermined temperature of 120° and the second predetermined temperature of 90° in an exemplary embodiment. Through significant testing, the inventor of the present application determined that an enhanced operability is achieved with these temperature settings. The predetermined temperatures can also be set in different ranges as desired. It is understood that the temperature sensor 102 can have the desired predetermined temperatures pre-set in the sensor during manufacture of the sensor 102. Other models of the temperature sensor 102 can also be selected that provide the ability to adjust the settings of the predetermined temperatures.

As further shown in the figures, the base 16 is formed by the interconnected members as described above. Similarly, the support frame 18 is formed by the interconnected members as described above. The support frame 18 is operably connected to the base 16 to form the frame assembly 12 by the cross members 52 wherein the internal space 30 is defined therein.

The heating system 14 is operably connected to the frame assembly 12. The plenum duct member 82 is operably positioned in the internal space 30 and connected to frame assembly 12. The plenum duct member 82 can be fastened into the base 16 via suitable screw fasteners. The outlet duct members 84 are positioned in respective outlet openings 20 of the base 16. The heating unit 70 is connected to the top surface 86 of the plenum duct member 82 using appropriate fasteners. The heating unit 70 is operably connected to the power inlet 78 to receive electrical power from the power source PS as is also operably connected to the inlet fuel hose 76 that is connected to the fuel source FS as described in further detail below. The outlet of the heating unit 70 is connected to the inlet duct member 80 wherein the duct member 80 is connected to the middle or central portion of the top surface 86 of the plenum duct member 82.

The temperature sensor 102 is connected to the top surface 86 of the plenum duct member 82 with the understanding the sensor 102 could be positioned in alternative locations. The blower fan 104 is connected to and mounted on the frame assembly 12 in one exemplary embodiment. In alternative embodiments, the blower fan 104 can be connected to the plenum duct member 82 such as on the top surface 86 of the plenum duct member 82 generally at an end of the plenum duct member 82 and generally adjacent the heating unit 70. FIG. 9 shows that the blower fan 104 can be positioned in different locations, though typically a single blower fan 104 is sufficient for operation. The blower fan 104 is also operably connected to temperature sensor 102 and power source PS through appropriate wiring as described herein.

Figure 12:
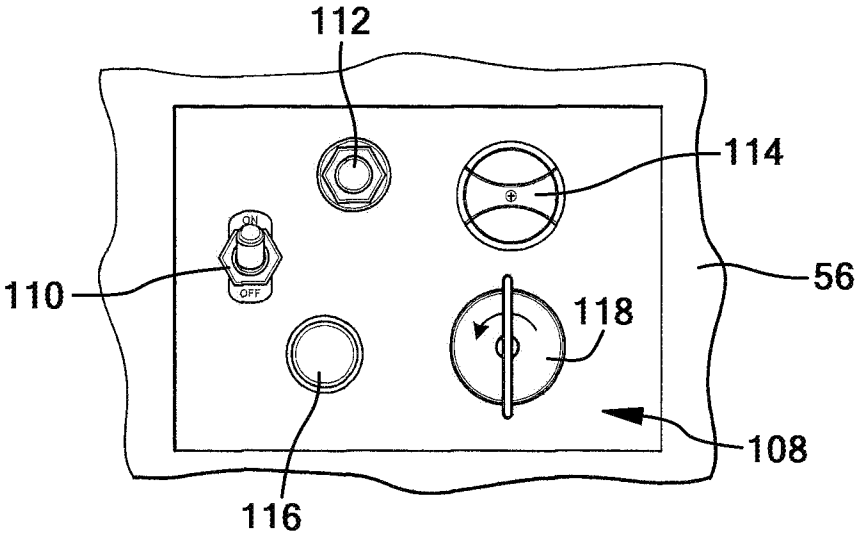
FIG. 12 is partial side elevation view of a control panel for the heating system of the heating table assembly.

FIG. 12 shows a control panel 108 associated with the various components used to control operation of the heating table assembly 10. The control panel 108 has a plurality of controls operably connected to the various components of the heating table assembly 10. For example, the controls include an on/off switch 110 for the heating unit 70 which controls the internal fan 68 of the heating unit 70 to force heated air through the duct assembly 72. The controls also include a first igniter 112 (thermoelectric valve) for the heating unit 70 which is in an activated configuration and operably associated with the heating unit 70 as is known. The controls further include a heater control knob 114 for a gas valve to control gas/fuel to the heating unit 70. The controls further include a second igniter 116 for the table top burner assembly 62 if utilized. The second igniter can be a battery-powered igniter if desired. The controls further include a gas control valve 118 for the top burner assembly 62 if utilized. It is understood that the aesthetic flame provided by the top burner assembly 62 is controlled in size such that the flame does not extend too far over the table top member 58. It is further understood that the various controls on the control panel 108 described above are operably connected to appropriate components of the heating system 14 through appropriate connections known in the art and as further described schematically below. It is understood that other controls could also be utilized including other wireless controls etc. In addition, the burners/burner assemblies associated with the heating system 14 are designed to be ignited through the controls described herein and known by those skilled in the art. The burners/burner assemblies could also be manually ignited if desired.

Figure 14:
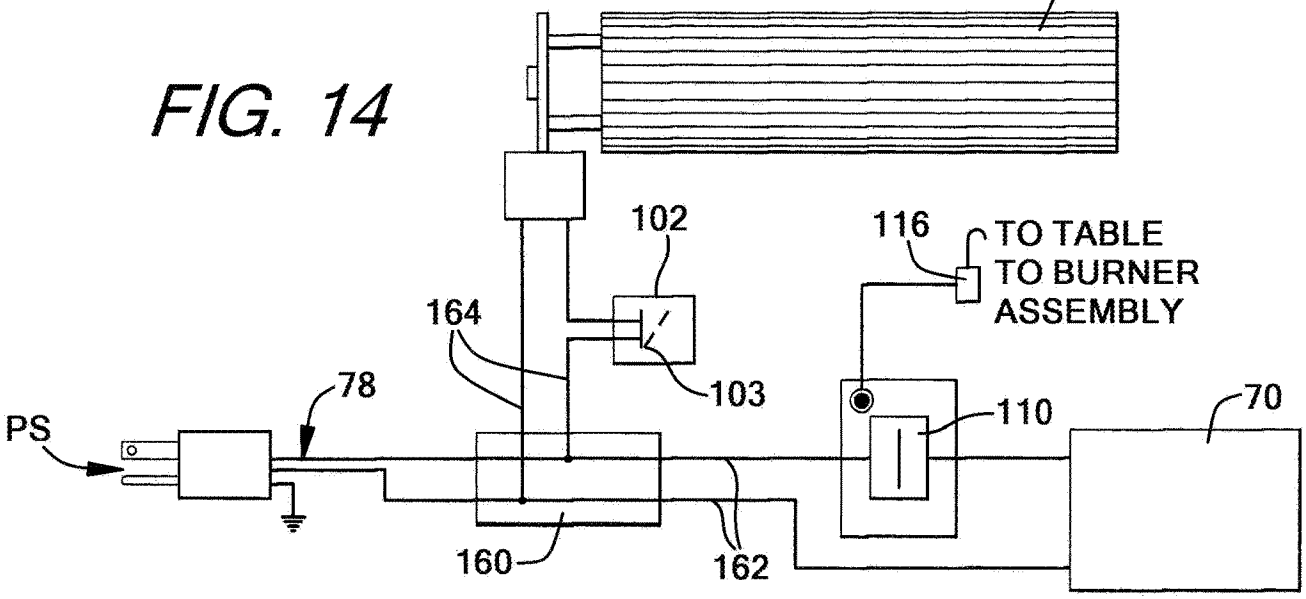
FIG. 14 is a power/electric schematic diagram for the heating table assembly of FIG. 1.

FIGS. 13-14 disclose additional schematic views and operable connections of the various components that may be considered a control system for use in operating the heating table assembly 10. FIG. 13 discloses a general fuel-schematic for controlling the fuel supply to the heating table assembly 10 for operation of the table assembly 10. As discussed, the fuel source FS can be a propane source, a natural gas source or some other suitable fuel source. As also discussed, the source could be in tank form, or be in a permanent conduit-type connection to a fuel source such as a propane source or natural gas source. For example, in a residential setting, the natural gas source could be branched off from a natural gas source of a house. From the fuel source FS, a gas regulator 142 can be utilized on a fuel supply line 144 to regulate the incoming fuel pressure. The fuel supply line 144 has a thermoelectric valve 146 downstream of the gas regulator 142 that functions as an igniter for the fuel. The thermoelectric valve generally corresponds to the pilot igniter for the heating unit 70 of the heating table assembly 10. The fuel supply line 144 further utilizes a fuel valve 148 downstream of the thermoelectric valve 146. The fuel valve 148 generally corresponds to the heater control knob 114 on the control panel 108. The fuel supply line 144 extends to and is operably connected to the inlet of the heating unit 70 as is known. In this configuration, a supply of fuel is controlled and regulated to the heating unit 70 to be burned by the internal burner 66 of the heating unit 70 in operation of the heating table assembly 10. If the heating table assembly 10 utilizes a table top burner assembly 62, the fuel line 144 has a t-divider to define a secondary fuel line 150 to supply fuel to the table top burner assembly 62. The secondary fuel line 150 utilizes a gas regulator 152 to control the fuel to the table top burner assembly 62. Downstream of the gas regulator 152, a fuel valve 154 is provided wherein the secondary fuel line 150 extends to and is operably connected to the table top burner assembly 62. The fuel valve 154 corresponds to the gas control valve 118 on the control panel 108. It is understood that other fittings and components can be used to operably supply fuel to the heating system 14.

FIG. 14 discloses an electrical-schematic for operation of the heating table assembly 10. A first electrical cable defining the electrical power inlet 78 has a traditional plug-in at one end for connection to a suitable electrical power source. The first electrical cable 78 extends to a junction box 160 and transitions to a second electrical cable 162 connected at the junction box 160 and having the heater On/Off switch 110 connected downstream of the junction box 160. The second electrical cable extends to and is operably connected to the heating unit 70 to power the internal fan 68 associated with the heating unit 70. At the junction box 162, a temperature-related electrical cable 154 is operably connected to the first electrical cable 78 to provide electrical power to the cooling assembly/blower fan 104 of the temperature regulation system 74. Downstream of the junction box, the temperature sensor 102 that utilizes the heat sensor relay thermostat 103 is operably connected to the temperature-related electrical cable 164. Thus, the temperature sensor 102 having the heat sensor relay 103 is shown schematically in the form of a thermostat on/off switch to activate and deactivate the fan 104. The temperature-related electrical cable 164 extends to and is operably connected to the cooling assembly/blower fan 104 of the temperature regulation system 74. As described herein, depending on the temperature sensed by the temperature sensor 102, and through operation of the heat sensor relay 103 associated with the temperature sensor 102 electrical power will either be delivered to the blower fan 104 through a made-up electrical circuit to activate the fan 104 or electrical power will be cut off from the blower fan 104 through an interrupted electrical circuit to deactivate the fan 104. It is understood that other fittings and components can be utilized to supply power as desired to the heating table assembly 10.

It is further understood that the planar surfaces forming the heating table assembly 10 are formed about the support frame 18 as desired. Thus, the vertical planar side/end surfaces 56 are formed on the support frame 18. In addition, the table top member 58 is also formed and operably connected to the support frame 18. The access panel 60 (FIG. 1) is also formed in the support frame 18. In an exemplary embodiment, the access panel 60 is formed in the first end frame 40 and end surface 56 of the support frame 18 closest to the heating unit 70 and blower fan 104. In an alternative configuration, it is understood that the table top member 58 can be designed to be removably attached to portions of the support frame 18 such as by screws or other removable fasteners. In such configuration, the table top member 58 can be removed to provide access to the internal space 30 such as if maintenance needs to be performed on various components of the heating table assembly 10 such as the heating system 14, duct assembly 72, temperature regulation system 74 or other components.

Figure 10:
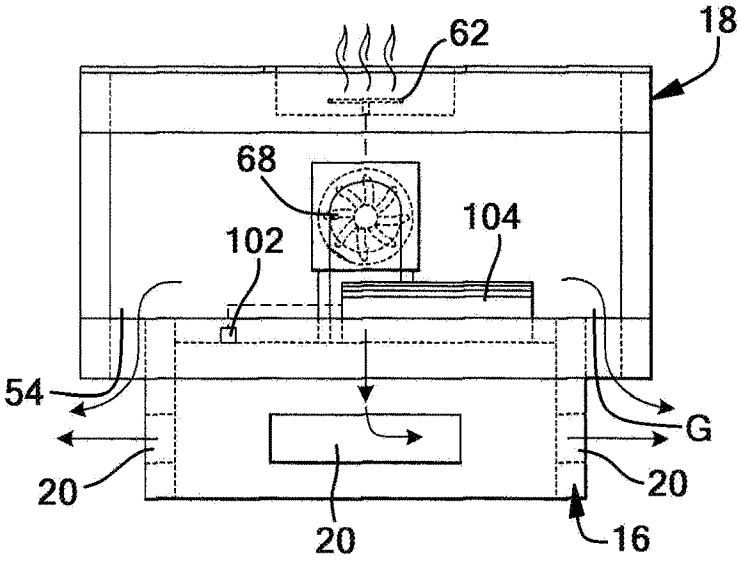
FIG. 10 is an end elevation view of the heating table assembly of FIG. 1 with portions of the support frame removed to show the internal space of the frame assembly to expose the heating system.
Figure 10A:
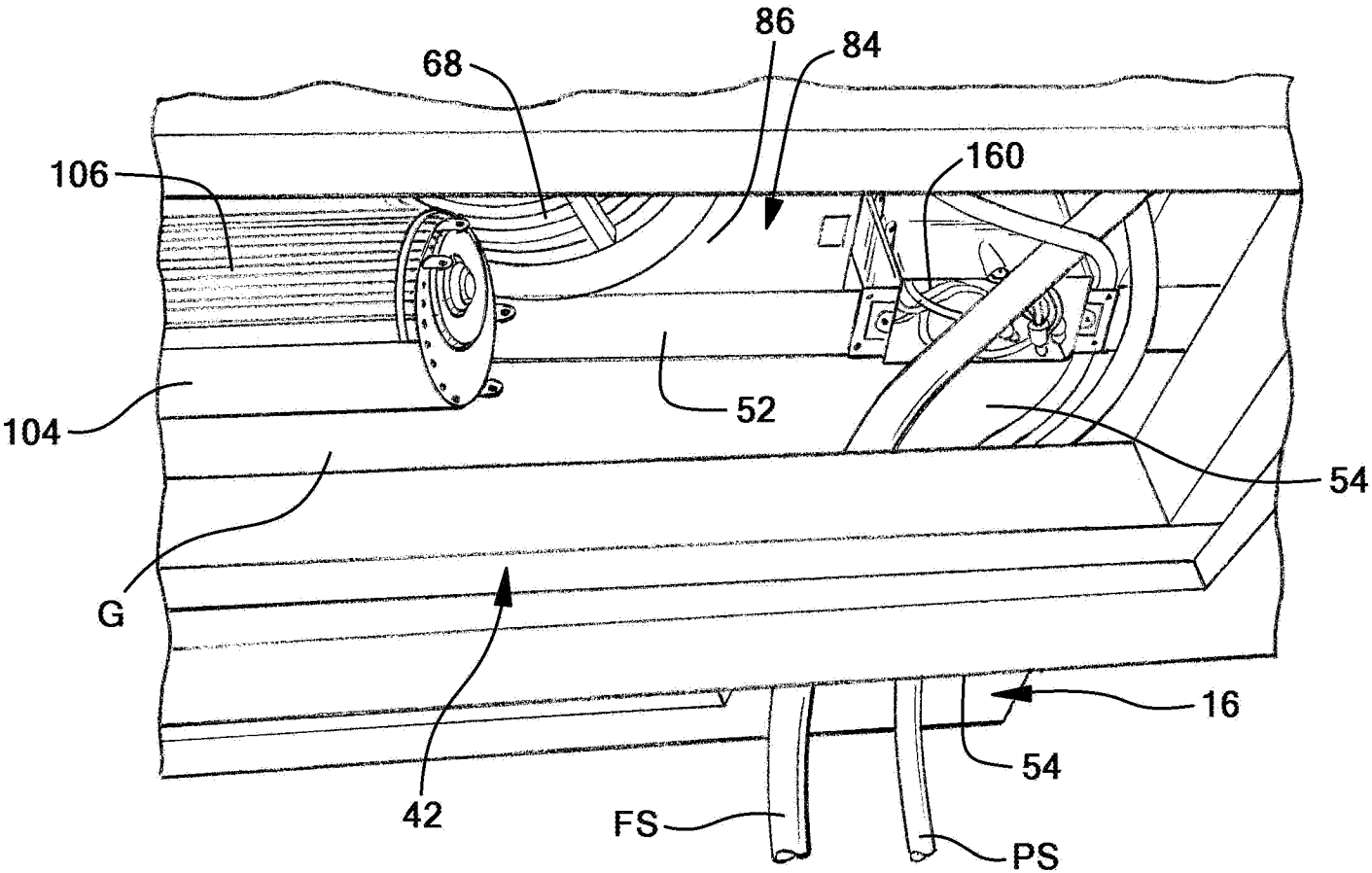
FIG. 10A is a partial perspective view of an end of the heating table assembly and showing a vertical frame opening and components positioned within an internal space of the frame assembly.
Figure 11:
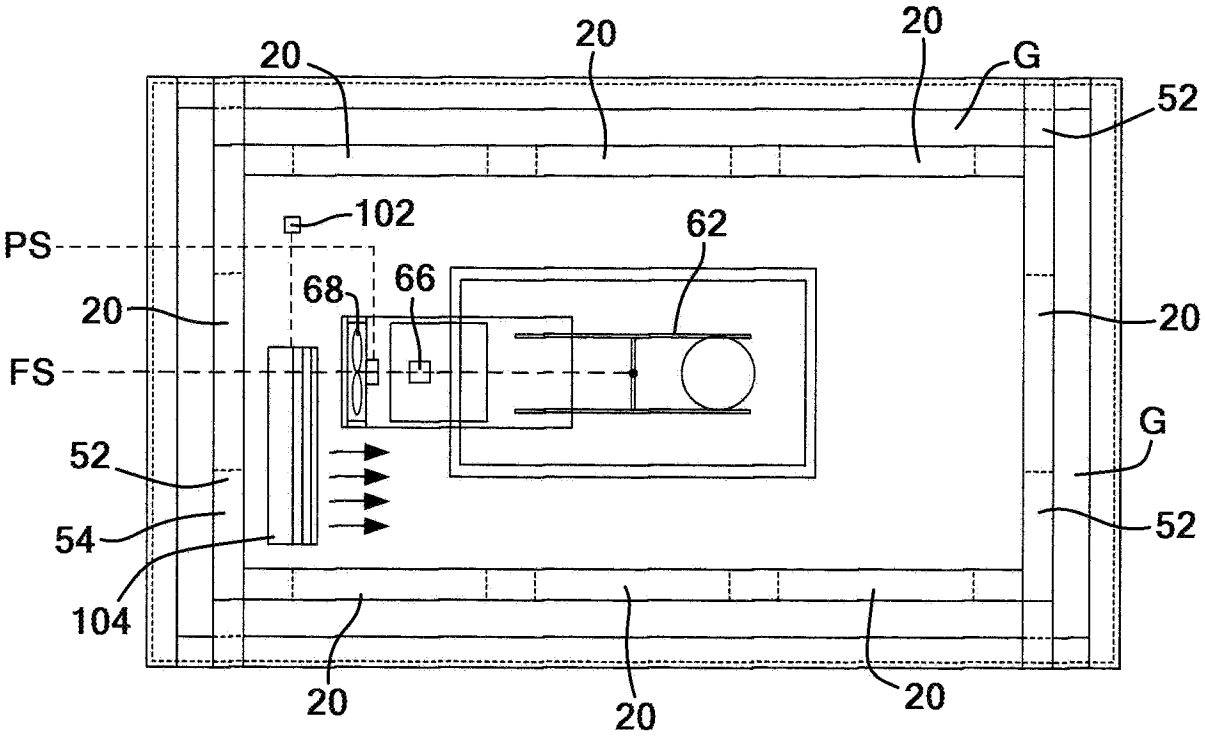
FIG. 11 is a top plan view of the heating table assembly of FIG. 1 with portions of a table top surface removed to show an internal space of the frame assembly to expose the heating system.
Figure 20:
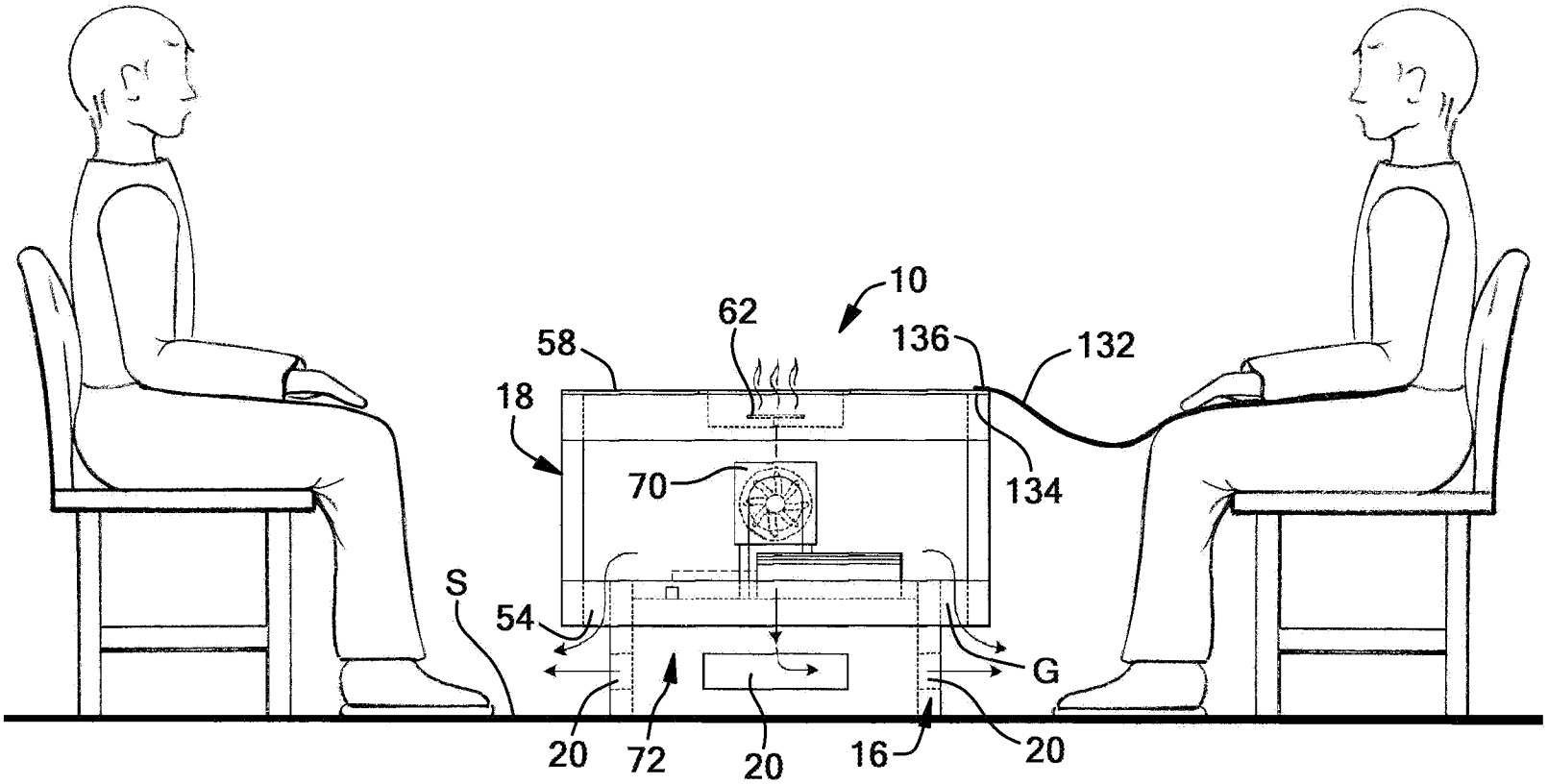
FIG. 20 is a side elevation view of the heating table assembly according to an exemplary embodiment of the present invention and showing users adjacent the table assembly.

In operation, a fuel source FS through the fuel inlet hose 76 is connected to the heating unit 70. In one exemplary embodiment, a propane source is provided to an inlet of the heating unit 70. As discussed, it is understood permanent supply lines could be installed in the environment and hard connected to the heating table assembly 10. Gas valves 146,148 are opened to provide fuel to the heating unit 70. The heating unit 70 is also connected to the power/electrical source PS via the electrical cable 78 to provide power to the heating unit 70 as well as to the temperature regulation system 74. An operator turns the heating unit 70 on via the on/off switch 110. An operator pushes the first igniter 112 to ignite the fuel supplied to the heating unit 70 to start operation of the heating unit 70. The internal burner 66 of the heating unit 70 burns the fuel and its internal fan 68 blows air therefrom which is heated air from the burning fuel. The heated air exits the heating unit 70 and passes through the inlet duct member 80. The heated air continues into the plenum duct member 82. Through continuous operation of the heating unit 70, the heated air is forced out of the outlet duct members 84 and the outlet openings 20 of the base 16. The outlet openings 20 are positioned generally adjacent the support surface S. This provides warmth to a user generally initially at feet or proximate lower body of the user, which has been found to be more efficient and desirable to a user as can be appreciated from FIG. 20. An operator can use the heater control knob 114 to control the level of heat. Persons sitting around the heating table assembly 10 and outlet openings 20 will feel warmth from the heated forced air emanating from the table assembly 10 through the outlet openings 20 (FIG. 20). As described above, the heated air forced into the plenum duct member 82 heats up the metal surfaces of the plenum duct member 82 and wherein overall temperature within the internal space 30 increases. If the temperature in the internal space 30 becomes too high, the heating unit 52 could overheat. The heating unit 70 is typically designed via internal components to turn off if temperatures around the heating unit 70 become too high. Thus, the heating unit 70 will automatically turn off or be deactivated which is undesirable. Operators must then restart the heating until 70 after temperatures dissipate causing disruptions for the operator and users of the table assembly 10. When the temperature sensor 102 of the temperature regulation system 74 senses the first predetermined temperature of 120°, the blower fan 104 is activated via heat sensor relay 103 of the temperature sensor 102 which blows air across the plenum duct member 82. This cools the plenum duct member 82 as well as the ambient temperature in the internal space 30. The forced air generated by the blower fan 104 exits through the gap G, or frame opening 54 or vertical outlet opening 54 such as shown in FIGS. 9-11 including FIG. 10A. When the temperature sensor 102 senses the second predetermined temperature of 90°, the blower fan 104 is deactivated via the heat sensor relay associated with the temperature sensor 102 as described above. The blower fan 104 will cycle on and off based on sensing the temperatures discussed above. It is understood that the temperature settings could be adjusted as desired. The temperature regulation system 74 further allows the table top member 58 to maintain a generally ambient temperature. It is also understood that the blower fan 104 can be positioned at different locations in the internal space 30. For example, the blower fan 104 can be positioned at an end of the plenum duct member 82 opposite the heating unit 70. With the heated forced air exiting the outlet openings 20, users sitting adjacent the table 10 will feel warmth of the heated air. Users also feel additional heated air through the gap G, or frame vertical outlet opening 54 when the blower fan 104 regulates the temperature of the plenum duct member 82 and internal space 30 (FIG. 20). Such heating table assembly 10 is ideal for colder weather atmospheres where despite colder temperatures, users can still enjoy an outdoor environment. As discussed, the outlet opening 20 may utilize the damper member 124. A user can engage the lever 128 to place the outlet opening 20 in an open configuration or a closed configuration. If the user no longer wishes to feel the heated air through the opening 20, the user can engage the lever 128 to place the damper 124 in the closed configuration thus closing the slats 126 in a vertical position preventing air from passing through the opening 20. It is understood that the lever 128 can be used to place the damper 124 in different degrees of the open configuration as well.

As discussed above, the heating unit 70 of the heating system 14 receives a fuel source such as from a propane tank or more permanent propane source via a hard connection. The heating unit 70 can also be designed to receive and burn a natural gas fuel supply. The heating table assembly 10 can also utilize additional alternative embodiments of heating systems 14 as described below.

Figure 15:
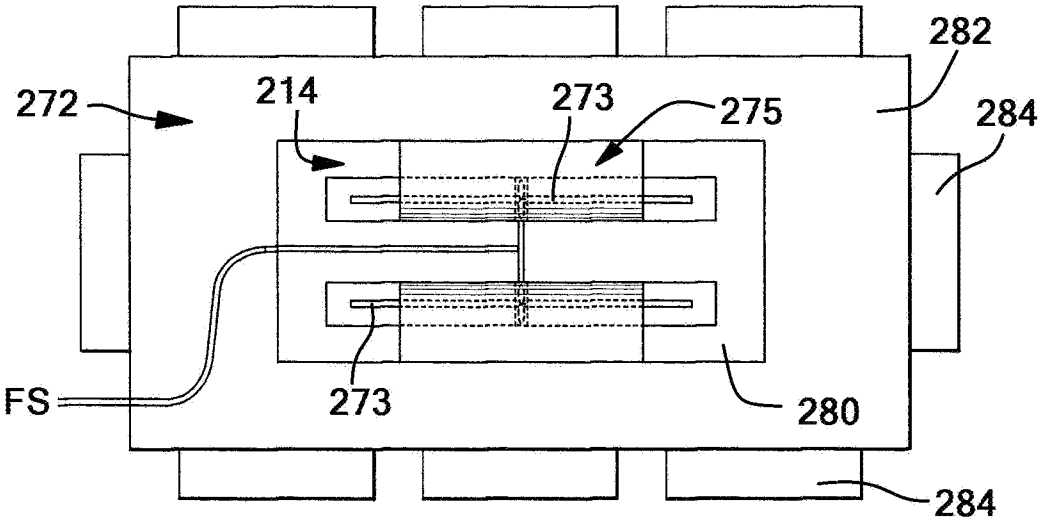
FIG. 15 is a schematic top plan view of an alternative heating system for the heating table assembly of the present invention.
Figure 16:
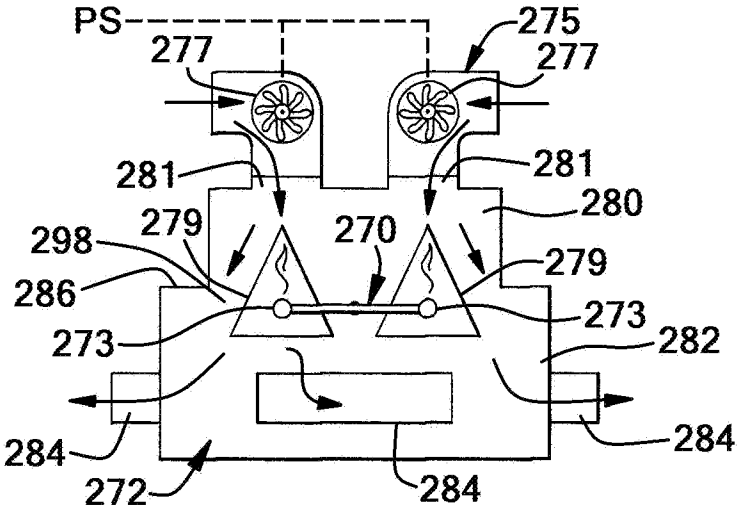
FIG. 16 is a schematic side end elevation view of the alternative heating system of FIG. 15.

FIGS. 15-16 disclose an alternative design of a heating system 14 for the heating table assembly 10. It is understood that similar structures are utilized in this design of the heating table assembly 10 and will be designated with similar reference numerals in a 200 series. The above description also applies to this alternative design where components are similar. It is understood that in this design, the heating table assembly 10 has the frame assembly 12 and a heating system 14. The frame assembly 12 to be used with this alternative design of the heating system 14 is generally similar in structure the frame assembly 12 described above. The heating system 14 also utilizes a heating unit 270 and a duct assembly 272. The duct assembly 272 also utilizes the inlet duct member 280, the plenum duct member 282 and the outlet duct member 284.

As further shown in FIGS. 15-16, the heating unit 270 takes the form of an internal burner assembly 271 that burns either propane or natural gas depending on the fuel source utilized for the heating table assembly 10. As can be further appreciated, the internal burner assembly 271 has a plurality of members that are interconnected such as to form a pair of elongated spaced manifold members 273. The manifold members 273 define an inner conduit and having a plurality of space openings. The heating unit 270 further utilizes a heat fan assembly 275. In one exemplary embodiment, the heat fan assembly 275 utilizes a pair of heater blower fans 277. The heater blower fans 277 may be similar to the blower fan 104 utilized in the temperature regulation system 74 described above. Thus, the heater blower fans 277 are squirrel-cage type fans known in the art and having a plurality of rotating impellers to move air. A heat shield member 279 is also utilized and is associated with the internal burner assembly 271. In an exemplary embodiment, a heat shield member 279 is provided with each manifold member 273. The heat shield member 289 generally has an inverted V-shape with an open bottom configuration.

As can be appreciated from FIGS. 15-16, the duct assembly 272 is operably connected to the base 16 similarly as described above. Thus, the plenum duct member 280 is positioned within the base 16 and secured thereto with appropriate fasteners. The outlet duct members 284 are received by the outlet openings 20 in the base 16. The plenum duct member 282 has the inlet opening 298 provided in the top surface 286 of the plenum duct member 282. While the inlet opening 98 of the plenum duct member 82 described above is a generally circular opening, the inlet opening 298 of this embodiment is generally rectangular and sized and dimensioned to accommodate manifold members 273 of the internal burner assembly 271. It is understood that the internal burner assembly 271 is operably connected to the duct assembly 272 such as proximate the plenum duct member 282. A first heat shield member 279 is positioned over the first manifold member 273 of the burner assembly 271 and a second heat shield member 279 is positioned over the second manifold member 273. The heat shield members 279 are operably connected to be supported over the manifold members 273 such as being connected to the burner assembly 271 or also to the duct assembly 272. The inverted V-shape of the heat shield member 279 allows the manifold member 273 to be positioned within the heat shield member 279. The inlet duct member 280 is operably connected to the plenum duct member 282 which covers the inlet opening 298. The inlet duct member 280 thus encloses the internal burner assembly 271 wherein the inlet duct member 280 is in fluid communication with the plenum duct member 282. The inlet duct member 280 also has an inlet opening 281 as shown in FIG. 16. The inlet opening 281 operably receives the heat fan assembly 275. In one exemplary embodiment, the inlet opening 281 comprises a pair of inlet openings 281. A first heater blower fan 277 is positioned in the first inlet opening 281 and a second heater blower fan 277 is positioned in the second inlet opening 281. Thus, all of these connected structures are positioned in the internal space 30 of the heater table assembly 10. Connections of the duct members 280,282,284 and heater blower fans 277 are made via fasteners and aluminum foil duct tape or other suitable connectors. The heater blower fans 277 are shown laterally spaced on along the plenum duct member 282 in one exemplary embodiment. It is understood that the heater blower fans 277 could also be aligned and spaced in a longitudinal fashion along the plenum duct member 282.

It is understood that the temperature regulation system 74 can also be utilized with the heating system 214 of FIGS. 15-16. In addition, the control components are also utilized such as described in FIGS. 13-14 regarding the electrical connections and gas supply connections.

In operation, electrical power PS is provided to the heater blower fans 277. The fuel supply FS is also attached to the internal burner assembly 271 of the heating unit 270. It is understood that the internal burner assembly 271 of the heating unit 270 also has an igniter associated therewith to light the burner assembly 271 to burn fuel. The burner assembly 271 is ignited wherein fuel is burned wherein flames emanate from the openings in the manifold members 273 as shown in FIG. 16. An on/off switch for the heater blower fans 277 is turned to an "on" position wherein the heater blower fans 277 are activated. The heater blower fans 277 draw air which is directed down over the heat shield members 279, wherein the air is heated and forced through the inlet duct member 280, the plenum duct member 282, through the outlet duct members 284 and thus through the outlet openings 20 of the base 16. The heat shield member 279 protects the flame of the burner assembly 271 such that the heater blower fans 277 do not inadvertently extinguish the internal burner assembly 271. The temperature regulation system 74 as described above can also be operably connected to the duct assembly 272 and frame assembly 12. Thus, when the first predetermined temperature is sensed, the cooling assembly is activated to direct air over the plenum duct member 282. When the second predetermined temperature is sense, the cooling assembly is deactivated. This cycling continues during operation of the heat table assembly 210.

In a further exemplary embodiment, the heating table assembly 10 may utilize a heat capture assembly 130 or blanket assembly 130. While users sitting adjacent the heating table assembly 10 feel significant warmth from the forced heated air coming from the outlet openings 20, and in particular at a position adjacent the support surface S, the heated air could dissipate more quickly around the table assembly 10. The heat capture assembly 130 allows a user to capture warmth around the user. The heat capture assembly 130 generally includes a blanket or cover member 132 designed to be removably attached to the heating table assembly 10.

Figure 17:
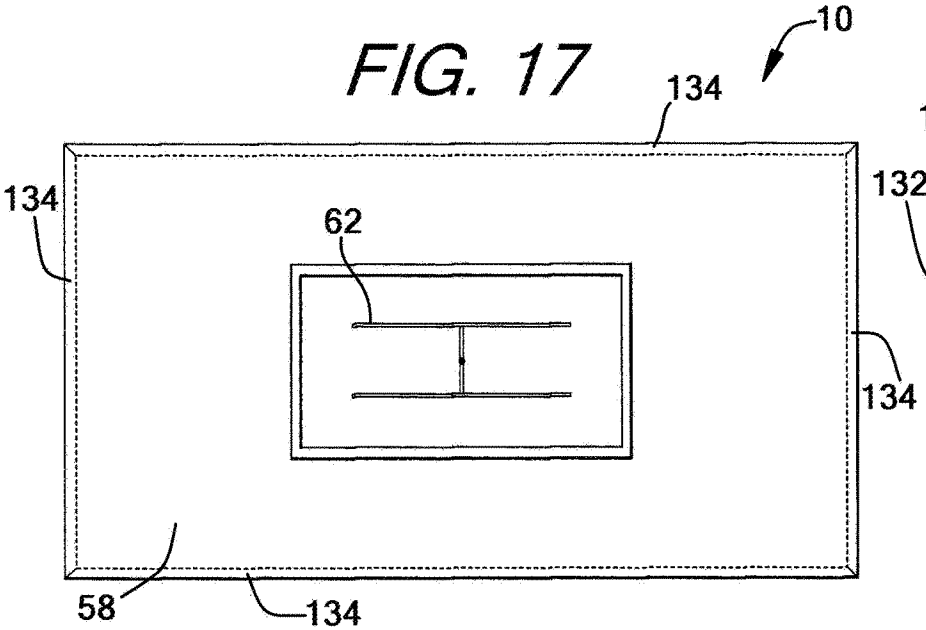
Figure 18:
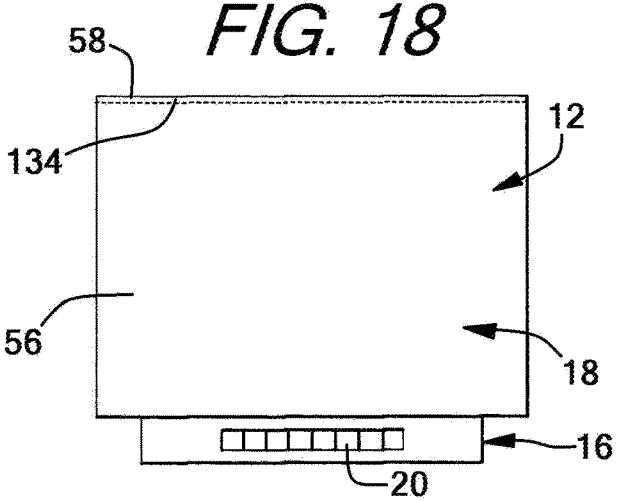

As shown in FIGS. 17-18, in this embodiment, the table top member 58 is equipped with a metal member 134. In an exemplary embodiment, the metal member 134 has a narrow, strip-like configuration. The metal member 134 is attached to the table top member 58. In an exemplary embodiment, the metal member 134 is embedded into the table top member 58. Thus, the metal member 134 can be pre-set or pre-connected in the table assembly 10 wherein the material, such as the plaster material described above, is poured or configured to form the planar table top member 58 and cover the metal member 134. The metal member 134 is also positioned generally proximate a peripheral edge of the table top member 58. Also in an exemplary embodiment, the metal member 134 has an elongated configuration dimensioned to extend along generally an entire peripheral edge of the table top member 58. It is understood that the metal member 134 can also have lesser lengths wherein the metal member 134 is positioned at strategic locations on/in the table top member 58. It is also understood that the metal member 134 could also be positioned in other locations such as a side surface.

Figure 19:
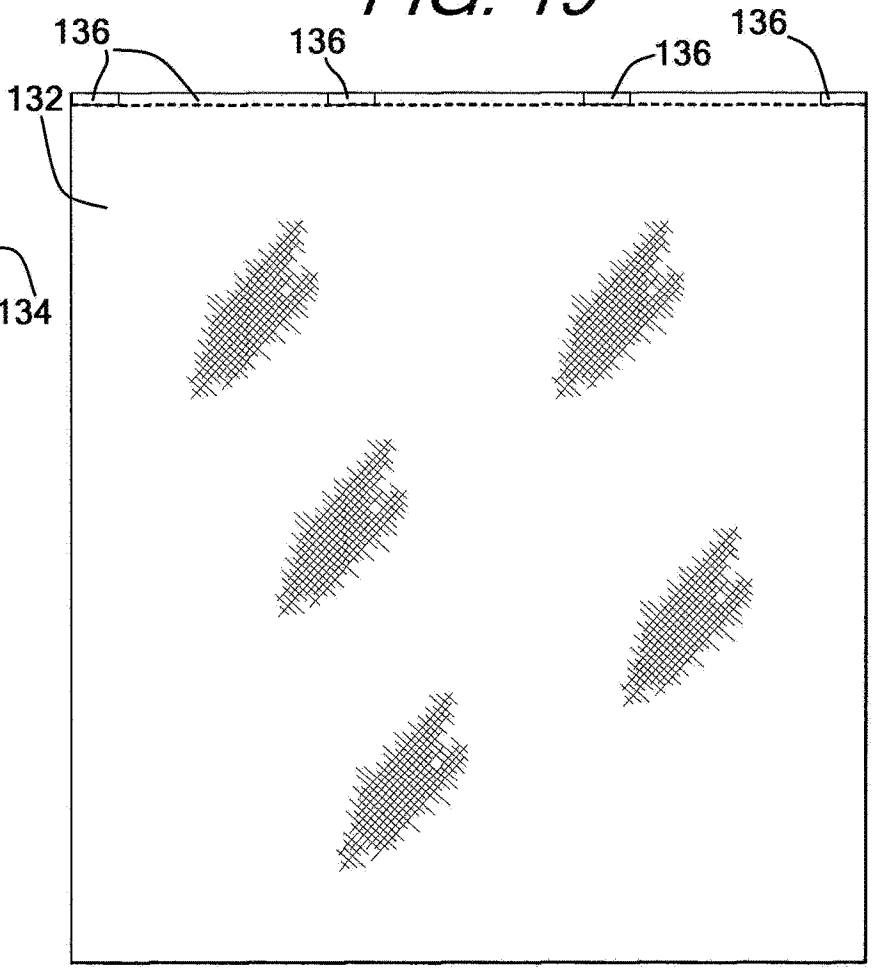
FIGS. 17-19 disclose a heat capture system that can be utilized with the heating table assembly according to another exemplary embodiment of the invention.

As also shown in FIG. 19, the blanket 132 or cover member 132 is provided. The blanket 132 has a magnet 136 attached to the blanket 132. In an exemplary embodiment, the magnet 136 is embedded in a peripheral edge of the blanket 132. The length of the magnet 136 generally corresponds to the length of the metal member 134 on the table top member 58, but lengths can differ if desired. Thus, the magnet 136 can be a flexible magnet in the form of an elongated strip generally corresponding to the length of the peripheral edge of the blanket 132. The flexible magnet 136 could also have lesser lengths if desired. Alternatively, the magnet 136 can comprise a plurality of smaller magnets 136 positioned in spaced relation along the length of peripheral edge of the blanket 132. It is understood that the blanket 132 is made from a fire-resistant material.

FIG. 20 further shows use of the heat capture assembly 130. The user places the peripheral edge of the blanket 132 on the table top member 58 proximate the location of the metal member 134, or peripheral edge of the table top member 58. The magnet 136 is attracted to the metal member 134 wherein the blanket 132 is connected to the table top member 58. It is understood that the metal member 134 and magnet 136 are selected and configured such that a sufficient magnetic pull exists between the metal member 134 embedded in the table top member 58 and magnet sewn into the peripheral edge of the blanket 132. As further shown in FIG. 20, the user, sitting adjacent the table assembly 10, places a free end of the blanket 132 over the lap of the user wherein the forced heated air from the outlet opening 20 is trapped under the blanket 132. The captured heated air provides more sustained warmth to the user. As the blanket 132 is magnetically attached to the table top member 46, a user can easily pull the blanket 132 away from the table top member 58 wherein the blanket 132 is removably attached to the table top member 58. While the blanket 132 is magnetically attached to the table top member 58, other methods to removably attach the blanket 132 to the table top member 58 can also be utilized. It is understood that the blanket 132 shown in FIG. 20 is positioned over a lap of a user and lateral ends of the blanket 132 could be draped around legs of the user or extended to adjacent users.

As shown in the figures, according to another exemplary embodiment of the invention, the heating table assembly 10 can also utilize the table top burner assembly 62 (FIG. 1) as is known in the art. The table top burner assembly 62 is positioned on the table top member 58 generally at a central portion of the table top member 58. The table top burner assembly 62 is operably connected to the heating system 14 that provides a fuel source to the burner assembly 62. It is further understood that the control panel 108 includes controls to operate the table top burner assembly 62 as well in the form of the second igniter 116. The system further includes fuel regulators to control the size of the flame emanating from the table top burner assembly 62. It is understood that in other exemplary embodiments, the table top burner assembly 62 is not utilized wherein the table top member 58 is generally a planar member.

It is understood that the heating table assembly 10 has a heating unit that generates heated force air to provide warmth to a user. It is further understood that the table assembly could also be used in a configuration where the heating unit is disabled and wherein the blower fan is utilized. In such configuration, the table assembly 10 can provide a degree of cooling to users positioned adjacent the table assembly 10.

It is understood that different exemplary embodiments are disclosed and described in the present application. The various exemplary embodiments share certain features and also utilize different features in certain embodiments. It is understood that the various features can be used in various combinations in yet further embodiments.

The heating table assembly provides several benefits. The heating table assembly provides a structure that easily and efficiently provides a heat source in conjunction with a table such as a patio table in, for example, a cooler/colder weather environment. Users can sit adjacent the table while feeling the warmth of heated forced air flowing from the table assembly. The outlet openings of the heating table assembly are positioned in a low configuration, generally adjacent the support surface that the table assembly rests upon. In such configuration, heated air is directed towards feet or lower body parts of users which often is more desirable for users. The structural configuration provides for efficient and enhanced airflow from the table. In addition, the heated table assembly has a temperature regulation system that prevents overheating and premature shutdown of the heating system. In addition, outer surfaces of the frame assembly do not become too hot to a touch of a user allowing for the table to be functionally used in entertainment settings. Additionally, the frame openings provide additional heated air towards a user. With the temperature regulation system, heated forced air can be delivered from the heating table assembly for extended periods of time without overheating of the heating system or surfaces of the heating table becoming too hot to the touch of users. Also, the structure of the frame assembly having the frame opening allows additional heated air to be directed towards users from operation of the temperature regulation system. Finally, the heating table assembly can utilize a heat capture assembly or blanket assembly to help users trap heated air generally at a seating location further increasing the efficiency of the table.

While the invention has been described in its preferred embodiments, it is to be understood that the words which have been used are words of description rather than limitation and that changes may be made within the purview of the appended claims without departing from the true scope and spirit of the invention in its broader aspects.

What is claimed is:

1. A heating table assembly comprising:

a frame assembly configured to be supported by a support surface, the frame assembly having a base and a support frame, the base having an outlet opening configured to be positioned adjacent the support surface;

a heating system operably associated with the frame assembly, the heating system having a heating unit connected to a duct assembly, the duct assembly having a duct outlet positioned at the outlet opening, the heating unit configured to generate heated forced air through the outlet opening configured to provide warmth to a user positioned generally adjacent the outlet opening; and, a temperature regulation system operably connected to the heating system, the temperature regulation system having a temperature sensor connected to the duct assembly and a fan mounted on the frame assembly, wherein in response to the temperature sensor sensing a first predetermined temperature, the fan is activated wherein air is directed over a top surface of the duct assembly to provide cooling to the heating system, and wherein the air passes through a vertical frame opening defined between the support frame and the base.

2. The heating table assembly of claim 1 wherein the frame assembly defines an internal space therein, the heating system contained in the internal space.

3. The heating table assembly of claim 1 wherein the base has a first longitudinal dimension and a first lateral dimension, and wherein the support frame has a second longitudinal dimension and a second lateral dimension, and wherein the second longitudinal dimension is greater than the first longitudinal dimension and the second lateral dimension is greater than the first lateral dimension, wherein a vertical frame opening is defined between the support frame and base around a periphery of the base.

4. The heating table assembly of claim 1 further comprising a temperature regulation system, the temperature regulation system operably connected to the heating system wherein in response to the duct assembly reaching a predetermined temperature, the temperature regulation system provides a supply of cooling air to reduce the temperature of the duct assembly.

5. The heating table assembly of claim 1 wherein in response to the temperature sensor sensing a second predetermined temperature, the fan is deactivated.

6. The heating table assembly of claim 1 wherein the temperature sensor is mounted on a top surface of the duct assembly and generally proximate the heating unit.

7. The heating table assembly of claim 1 further comprising a damper member positioned in the outlet opening, the damper member having a closed configuration and an open configuration.

8. The heating table assembly of claim 1 wherein the support frame defines an end frame member, the end frame member supporting a removable access panel providing access to the heating system.

9. The heating table assembly of claim 1 further comprising a burner assembly supported on a top surface of the support frame, the burner assembly operably connected to the heating unit, the burner assembly providing an aesthetic flame member.

10. The heating table assembly of claim 1 further comprising a blanket having a proximal end removably attached to a top surface of the support frame wherein a free distal end of the blanket is configured to cover a user's legs positioned generally adjacent to the heating table assembly wherein heated forced air through the outlet opening is contained under the blanket.

11. The heating table assembly of claim 10 wherein the support frame defines a top surface wherein the top surface has a metal member operably connected thereto proximate a peripheral edge of the top surface, and wherein the blanket has a magnet member operably connected to the proximal end of the blanket, wherein the magnet is removably attached to the metal member.

12. The heating table assembly of claim 11 wherein the metal member is embedded in the top surface, and the magnet is positioned within a seam of the blanket at the proximal end of the blanket, wherein the magnet is attracted to the metal member through the blanket and top surface.

13. The heating table assembly of claim 11 wherein the metal member is embedded in the top surface around a full periphery of the top surface.

14. The heating table assembly of claim 1 wherein the heating unit is a propane heating unit having a burner and an internal fan, the burner being configured to be operably connected to a fuel source and the internal fan being configured to be operably connected to a power source wherein the heating unit generates heated forced air to the duct assembly.

15. The heating table assembly of claim 1 wherein the base and support frame define an internal space, wherein the heating system is contained completely within the internal space.

16. A heating table assembly comprising:

a frame assembly configured to be supported by a support surface, the frame assembly having a base and a support frame, the base having an outlet opening configured to be positioned adjacent the support surface, wherein a vertical frame opening is defined between the base and the support frame;

a heating system operably associated with the frame assembly, the heating system having a heating unit connected to a duct assembly, the duct assembly having a duct outlet positioned at the outlet opening, the heating unit being configured to be operably connected to a fuel source and a power source and configured to generate heated forced air through the outlet opening;

a temperature regulation system being configured to be operably connected to the power source and having a temperature sensor and a cooling assembly, the temperature sensor operably connected to the cooling assembly, the temperature sensor positioned on the duct assembly and the cooling assembly operably associated with the duct assembly, wherein the heating system generates heated air forced into the duct assembly wherein the heated forced air exits through the outlet opening of the base, and wherein in response to the temperature sensor sensing a first predetermined temperature, the cooling assembly is activated wherein air is directed over the duct assembly to provide cooling to the heating system, wherein the air directed over the duct assembly exits through the vertical frame opening, wherein in response to the temperature sensor sensing a second predetermined temperature, the cooling assembly is deactivated, wherein the air exiting the outlet opening is configured to provide warmth to a user positioned generally adjacent the outlet opening.

17. The heating table assembly of claim 16 wherein the cooling assembly comprises a fan mounted on the frame assembly and generally adjacent to the duct assembly.

18. The heating table assembly of claim 16 wherein the temperature sensor has a heat sensor relay wherein upon sensing the first predetermined sensor the heat sensor relay connects the cooling assembly to the power source to activate the cooling assembly, and wherein upon sensing the second predetermined sensor the heat sensor relay disconnects the cooling assembly from the power source to deactivate the cooling assembly.

19. A heating table assembly comprising:

a frame assembly configured to be supported by a support surface, the frame assembly having a base and a support frame, the base having an outlet opening configured to be positioned adjacent the support surface, wherein a vertical frame opening is defined between the base and the support frame;

a heating system operably associated with the frame assembly, the heating system having a heating unit connected to a duct assembly, the duct assembly having a duct outlet positioned at the outlet opening;

a temperature regulation system having a temperature sensor and a fan, the temperature sensor operably connected to the fan, the temperature sensor positioned on the duct assembly and the fan connected to the frame assembly proximate the duct assembly, a propane tank operably connected to the heating system and providing propane fuel to the heating unit to generate heated forced air through the outlet opening;

a power source operably connected to the heating system and temperature regulation system;

wherein the heated forced air generated by the heating unit is directed into the duct assembly wherein the heated forced air exits through the outlet opening of the base, and wherein in response to the temperature sensor sensing a first predetermined temperature, the fan is activated wherein air is directed over the duct assembly to provide cooling to the heating system wherein the air exits through the vertical frame opening, wherein in response to the temperature sensor sensing a second predetermined temperature, the fan is deactivated, wherein the heated forced air exiting the outlet opening and the air exiting the vertical frame opening are configured to provide warmth to a user positioned generally adjacent the outlet opening.

20. A heating table assembly comprising:

a frame assembly configured to be supported by a support surface, the frame assembly having a base and a support frame collectively defining an internal space, the base having a first side beam member and a second side beam member spaced by and connected to a first end beam member and a second end beam members, the side beam members and the end beam members defining a plurality of outlet openings therein configured to be positioned adjacent the support surface;

the support frame having a first side frame and a second side frame spaced by and connected to a first end frame and a second end frame, the support frame further having a top member, the support frame connected to the base by a plurality of cross-members, the support frame extending beyond the base and defining a vertical frame opening, a heating system positioned in the internal space of the frame assembly, the heating system having a heating unit connected to a duct assembly, the duct assembly having a plurality of duct outlets, one of the plurality of duct outlets positioned at a respective one of the plurality of outlet openings, the heating unit having an internal burner configured to be operably connected to a fuel source and an internal fan configured to be operably coupled to a power source, the heating unit generating heated forced air into the duct assembly and through the outlet openings;

a temperature regulation system having a temperature sensor and a fan, the temperature sensor having a heat sensor relay and being operably connected to the fan, the temperature sensor positioned on a top surface of the duct assembly and the fan positioned on the support frame generally adjacent the duct assembly, the fan configured to be operably connected to the power source; and wherein the heating system generates heated forced air into the duct assembly wherein the heated forced air exits through the outlet openings of the base, and wherein in response to the temperature sensor sensing a first predetermined temperature, the heat sensor relay connects the fan to the power source wherein the fan is activated wherein air is directed over the duct assembly to provide cooling to the heating system wherein air directed from the fan exits through the vertical frame opening, wherein in response to the temperature sensor sensing a second predetermined temperature, the heat sensor relay disconnects the fan from the power source wherein the fan is deactivated, and wherein the air exiting the outlet openings and frame opening is configured to provide warmth to a user positioned generally adjacent the outlet openings.

21. The heating table of claim 20 wherein the end beam members of the base define a respective outlet opening therein, and the side beam members defining a respective plurality of outlet openings therein, wherein each outlet opening of the side beam members has a damper member therein, each damper member having an open configuration allowing heated forced air to pass therethrough and a closed configuration obstructing heated forced air from passing therethrough, and wherein the outlet openings in the end beam members are unobstructed.

22. A heating table assembly comprising:

a frame assembly configured to be supported by a support surface, the frame assembly having a base and a support frame, the base having an outlet opening configured to be positioned adjacent the support surface;

a heating system operably associated with the frame assembly, the heating system having a heating unit connected to a duct assembly, the duct assembly having a duct outlet positioned at the outlet opening, the heating unit capable of generating heated forced air through the outlet opening configured to provide warmth to a user positioned generally adjacent the outlet opening; and, a blanket having a proximal end removably attached to a top surface of the support frame wherein a free distal end of the blanket is configured to cover a user's legs positioned generally adjacent to the heating table assembly wherein heated forced air through the outlet opening is contained under the blanket.

* * * * *